US007631866B2

(12) United States Patent
Otomo et al.

(10) Patent No.: US 7,631,866 B2
(45) Date of Patent: Dec. 15, 2009

(54) SHEET PROCESSING APPARATUS, SHEET ALIGNER, AND SHEET ALIGNING METHOD

(75) Inventors: Satoshi Otomo, Yashlo (JP); Daisaku Horikawa, Yashlo (JP); Hideaki Hosoi, Yashio (JP)

(73) Assignee: Ricoh Co., Ltd., Tokyo (JP)

( * ) Notice: Subject to any disclaimer, the term of this patent is extended or adjusted under 35 U.S.C. 154(b) by 160 days.

(21) Appl. No.: 11/723,019

(22) Filed: Mar. 15, 2007

(65) Prior Publication Data

US 2007/0219080 A1 Sep. 20, 2007

(30) Foreign Application Priority Data

Mar. 17, 2006 (JP) ..... 2006-075246

(51) Int. Cl.
*B65H 5/00* (2006.01)
*B65H 9/00* (2006.01)

(52) U.S. Cl. ..... 271/225; 271/234; 271/238; 271/240

(58) Field of Classification Search ..... 271/225, 271/234, 238, 240; 493/417, 416, 458
See application file for complete search history.

(56) References Cited

U.S. PATENT DOCUMENTS 4,540,458 A * 9/1985 Baughman et al. ..... 156/312
5,074,544 A * 12/1991 Kulpa et al. ..... 271/225
5,449,165 A * 9/1995 Naramore ..... 271/225
5,653,438 A * 8/1997 Crowley et al. ..... 271/225
5,667,214 A * 9/1997 Belec et al. ..... 271/225
6,102,391 A * 8/2000 Malick et al. ..... 271/225
6,164,640 A * 12/2000 Stengl et al. ..... 271/187
6,663,101 B2 * 12/2003 Barrand ..... 271/184
2002/0079643 A1 * 6/2002 Barrand ..... 271/225
2003/0107169 A1 * 6/2003 Rider ..... 271/225
2003/0137100 A1 * 7/2003 Hsieh ..... 271/225

FOREIGN PATENT DOCUMENTS

JP 61-226461 10/1986
JP 05-238641 9/1993
JP 2000-219418 8/2000

* cited by examiner

*Primary Examiner*—David H Bollinger
(74) *Attorney, Agent, or Firm*—Harness, Dickey & Pierce, P.L.C.

(57) ABSTRACT

A sheet processing apparatus includes: a first folder to fold a sheet in a first folding direction relative to a given orientation of the sheet, a line of the fold defining a second edge of the sheet; a second folder to fold the folded sheet in a second folding direction perpendicular to the first folding direction; and a switcher, disposed between the first folder and the second folder, operable to switch a sheet conveyance direction of the sheet sent from the first folder and to align the sheet sent from the first folder, the switcher including the following, an aligning member arranged to face a first edge of the sheet, the first edge of the sheet being located relatively opposite to the second edge along the conveyance direction, the second edge not having a straight line shape, and a feeder to force the sheet in a given direction toward the aligning member so as to align the sheet in the sheet conveyance direction by contacting the first edge of the sheet against the aligning member.

14 Claims, 31 Drawing Sheets

SHEET PROCESSING APPARATUS, SHEET ALIGNER, AND SHEET ALIGNING METHOD

PRIORITY STATEMENT

The present patent application claims priority under 35 U.S.C. §119 upon Japanese Patent Application No. 2006-075246 filed on Mar. 17, 2006 in the Japan Patent Office, the entire contents of each of which are incorporated by reference herein.

BACKGROUND

1. Technical Field

Some example embodiments of the present invention generally relate to a sheet processing apparatus, a sheet aligner, and a sheet aligning method for aligning a sheet, for example, a folded sheet.

2. Description of Background Art

A background image forming apparatus, such as a copying machine, a facsimile machine, a printer, or a multifunction printer having copying, printing, scanning, and facsimile functions, forms an image on a recording medium (e.g., a sheet) according to image data. For example, a sheet is sent from a paper tray to an image forming unit. The image forming unit forms an image on the sheet. The sheet bearing the image is output onto an output tray.

When the image forming apparatus forms an image on a large sheet (e.g., an A0 or A1 size sheet) used for drawings, the output tray may not receive the large sheet. If the output tray is large enough to receive the large sheet, then the output tray may be too large to save space. To address this problem, the image forming apparatus is connected to a sheet processing apparatus for folding the large sheet into a small size, folded sheet.

One example of a background sheet processing apparatus includes a jogger fence and a staple fence arranged opposite to each other. When the sheet processing apparatus receives a signal for indicating the size of a sheet to be aligned by the jogger fence and the staple fence from the image forming apparatus, the jogger fence and the staple fence move closer to each other to a standby position so as to be ready for receiving the sheet. At the standby position, a gap of about 10 mm is provided between the jogger fence and an edge of the sheet and between the staple fence and another edge of the sheet. When the jogger fence and the staple fence receive the sheet, the jogger fence further moves toward the staple fence by about 20 mm to align the sheet. Namely, only the jogger fence moves to align the sheet. Therefore, if the sheet is substantially skewed when the jogger fence and the staple fence receive the sheet, the sheet may not be properly aligned.

Another example of a background sheet processing apparatus includes a first folder, a switcher, and a second folder. The switcher includes a sheet guide, an adjuster including a stopper, and a feeder. The second folder includes a folding roller.

The first folder folds a sheet in a first direction. The switcher switches a sheet conveyance direction of the sheet sent from the first folder. Specifically, the sheet guide guides the folded sheet sent from the first folder toward the adjuster. The adjuster performs a registration adjustment on the sheet by causing the sheet to contact the stopper. The feeder feeds the sheet toward the second folder. The second folder folds the sheet in a second direction perpendicular to the first direction.

When the first folder has folded a corner of the head of the sheet, the head of the sheet partially contacts the stopper, resulting in buckling of the sheet. The stopper is not movable. Therefore, when the sheet is conveyed to the second folder, a center line of the sheet in a direction perpendicular to a sheet conveyance direction may vary depending on the type of folding performed by the first folder. Thus, a center of the folding roller in a longitudinal direction of the folding roller may not contact the center line of the sheet in the direction perpendicular to the sheet conveyance direction. When the sheet processing apparatus further includes a tuning device for tuning the sheet folded by the second folder, the sheet may not pivot on the center of the sheet, preventing the turning device from having a compact size.

SUMMARY

At least one embodiment of the present invention provides a sheet processing apparatus including: a first folder to fold a sheet in a first folding direction relative to a given orientation of the sheet, a line of the fold defining a second edge of the sheet; a second folder to fold the folded sheet in a second folding direction perpendicular to the first folding direction; and a switcher, disposed between the first folder and the second folder, operable to switch a sheet conveyance direction of the sheet sent from the first folder and to align the sheet sent from the first folder, the switcher including the following, an aligning member arranged to face a first edge of the sheet, the first edge of the sheet being located relatively opposite to the second edge along the conveyance direction, the second edge not having a straight line shape, and a feeder to force the sheet in a given direction toward the aligning member so as to align the sheet in the sheet conveyance direction by contacting the first edge of the sheet against the aligning member.

At least one embodiment of the present invention provides a sheet aligner for aligning a sheet, the sheet aligner including: an aligning member arranged to face a first edge of the sheet, the first edge of the sheet being located relatively opposite to a second edge along a conveyance direction of the sheet, the second edge not having a straight line shape; and a feeder to force the sheet in a given direction toward the aligning member so as to align the sheet in the sheet conveyance direction by contacting the first edge of the sheet against the aligning member.

At least one embodiment of the present invention provides a sheet aligning method for aligning a sheet having a foremost edge and a tail edge relative to a sheet conveyance direction, the foremost edge being folded and thereby not having a straight line shape, the sheet aligning method including: moving an aligning member to face the tail edge of the sheet and yet be located at a reference position that leaves a space that is between the aligning member and the tail edge of the sheet; moving a feeder from a standby position at which the feeder does not contact the sheet to a pressing position at which the feeder pressingly contacts the sheet; causing the feeder to move the sheet in a given direction toward the aligning member so that the tail edge of the sheet contacts the aligning member; and returning the feeder from the pressing position to the standby position.

Additional features and advantages of the present invention will be more fully apparent from the following detailed description of example embodiments, the accompanying drawings, and the associated claims.

BRIEF DESCRIPTION OF THE DRAWINGS

A more complete appreciation of the present invention and the many attendant advantages thereof will be readily obtained as the same becomes better understood by reference to the following detailed description of example embodiments when considered in connection with the accompanying drawings, wherein.

Figure 1:
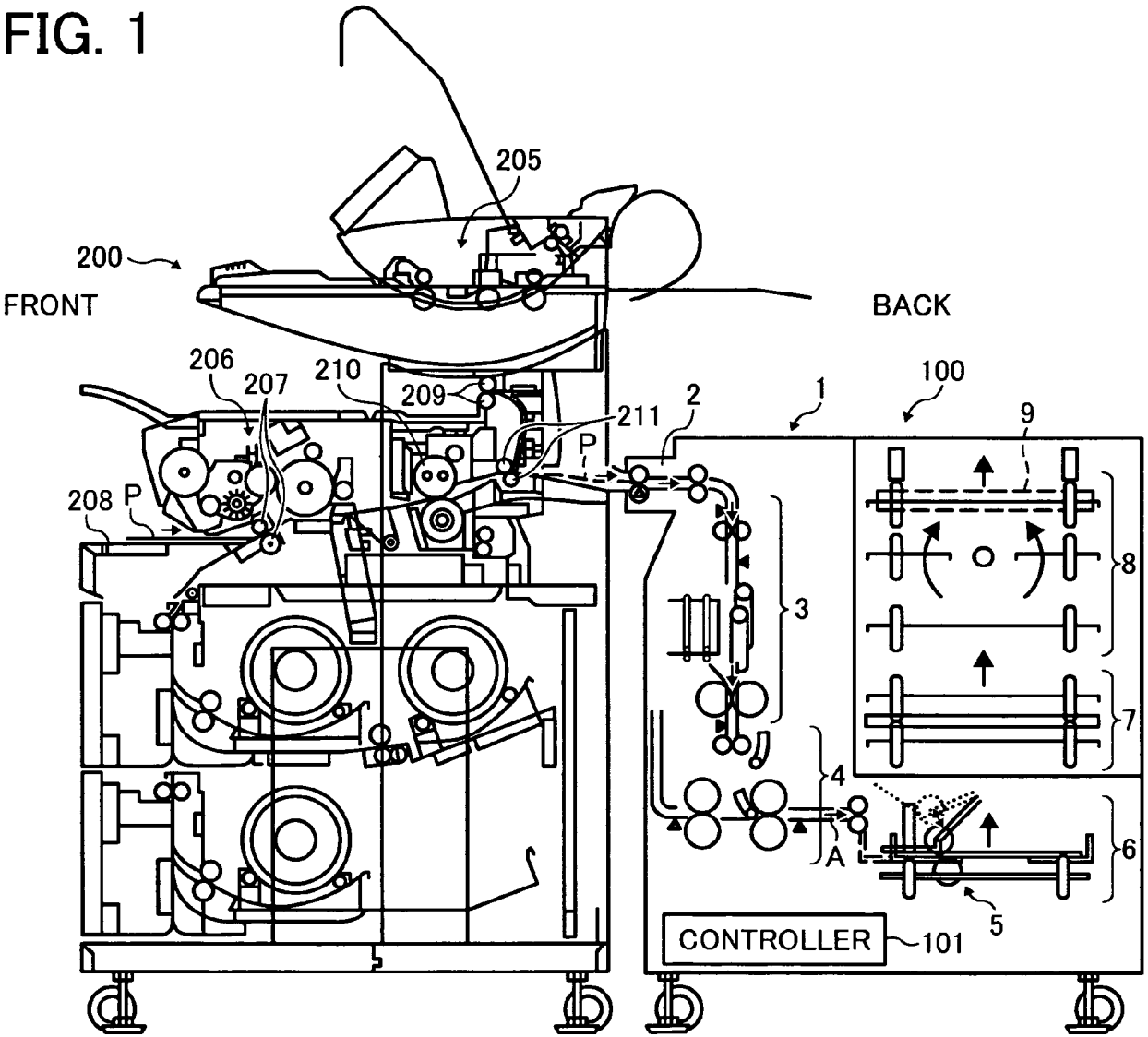
FIG. 1 is a sectional side view of an image forming apparatus and a sheet processing apparatus according to an example embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/of" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 200 and a sheet processing apparatus 100 according to an example embodiment of the present invention are explained.

FIG. 1 is a sectional side view of the image forming apparatus 200 and the sheet processing apparatus 100. The sheet processing apparatus 100 is separately provided from the image forming apparatus 200 and is optionally connected to the image forming apparatus 200. However, the sheet processing apparatus 100 may be included in the image forming apparatus 200. The image forming apparatus 200 may be a copying machine, a printer, a facsimile machine, a multifunction printer having copying, printing, scanning, and facsimile functions, or the like, which forms an image on a recording medium (e.g., a sheet). Types of recording medium other than, or in addition to, paper can be used. According to this non-limiting example embodiment, the image forming apparatus 200 functions as a copying machine for forming an image on a sheet by an electrophotographic method. However, the image forming apparatus 200 may form an image on a sheet by an inkjet method, a thermal transfer method, or the like. Namely, the image forming apparatus 200 can be applied to known image forming apparatuses for forming an image on a recording medium.

The sheet processing apparatus 100 is connected to the back of the image forming apparatus 200, and performs processing (e.g., folding, aligning, reversing, turning, and/or the like) on a sheet sent from the image forming apparatus 100.

As illustrated in FIG. 1, the image forming apparatus 200 includes an image reader 205, a bypass tray 208, a registration roller pair 207, an image forming unit 206, a fixing unit 210, a lower output roller pair 211, and/or an upper output roller pair 209. The sheet processing apparatus 100 includes a sheet folder 1 and/or a controller 101. The sheet folder 1 includes a connecting portion 2, a corner folder 3, an accordion folder 4, a switcher 5, a cross folder 6, a reversing device 7, a turning device 8, and/or an output tray 9.

The image reader 205 scans an image on an original sheet to create image data. The bypass tray 208 is disposed under the image reader 205. A user inserts a sheet P onto the bypass tray 208. The registration roller pair 207 temporarily holds the sheet P and feeds the sheet P at a proper time toward the image forming unit 206. In the image forming unit 206, an electrostatic latent image is formed on a surface of a photoconductor (not shown) according to the image data created by the image reader 205. A development unit (not shown) develops the electrostatic latent image with a toner to form a toner image. A transferor (not shown) transfers the toner image formed on the surface of the photoconductor onto the sheet P fed by the registration roller pair 207. The sheet P bearing the toner image is fed toward the fixing unit 210. The fixing unit 210 fixes the toner image on the sheet P and feeds the sheet P bearing the fixed toner image toward the lower output roller pair 211. When the user instructs the image forming apparatus 200 to perform sheet processing on the sheet P bearing the fixed toner image, the lower output roller pair 211 feeds the sheet P toward the sheet processing apparatus 100. When the user does not instruct the image forming apparatus 200 to perform sheet processing on the sheet P bearing the fixed toner image, a switching nail (not shown) leads the sheet P toward the upper output roller pair 209. The upper output roller pair 209 feeds the sheet P onto the outside of the image forming apparatus 200.

The sheet folder 1 folds the sheet P sent from the image forming apparatus 200. For example, the corner folder 3, serving as a first folder, folds a corner of the sheet P. The accordion folder 4, serving as a first folder, accordion-folds the sheet P in a sheet conveyance direction. The cross folder 6, serving as a second folder, folds the sheet P along a direction perpendicular to a longitudinal direction of the accordion-folded sheet P.

When the lower output roller pair 211 feeds the sheet P toward the sheet processing apparatus 100, the sheet P fed by the lower output roller pair 211 is conveyed in the connecting portion 2 connected to the image forming apparatus 200 toward the corner folder 3. The corner folder 3 folds a corner of the sheet P and feeds the sheet P toward the accordion folder 4. The accordion folder 4 accordion-folds the sheet P in the sheet conveyance direction and feeds the sheet P toward the switcher 5. The switcher 5, serving as a sheet aligner, switches the sheet conveyance direction of the sheet P by turning the direction in which the sheet P is conveyed by about 90 degrees, and feeds the sheet P toward the cross folder 6. The cross folder 6 folds the sheet P along the direction perpendicular to the longitudinal direction of the accordion-folded sheet P, and feeds the sheet P toward the reversing device 7. The reversing device 7 reverses the sheet P and feeds the sheet P toward the turning device 8. The turning device 8 turns the sheet P by about 90 degrees, and feeds the sheet P toward the output tray 9. For example, the turning device 8 changes the orientation of the sheet P from a landscape orientation to a portrait orientation, for example. The output tray 9 receives the sheet P. The controller 101 controls operations of the sheet processing apparatus 100.

Figure 2:
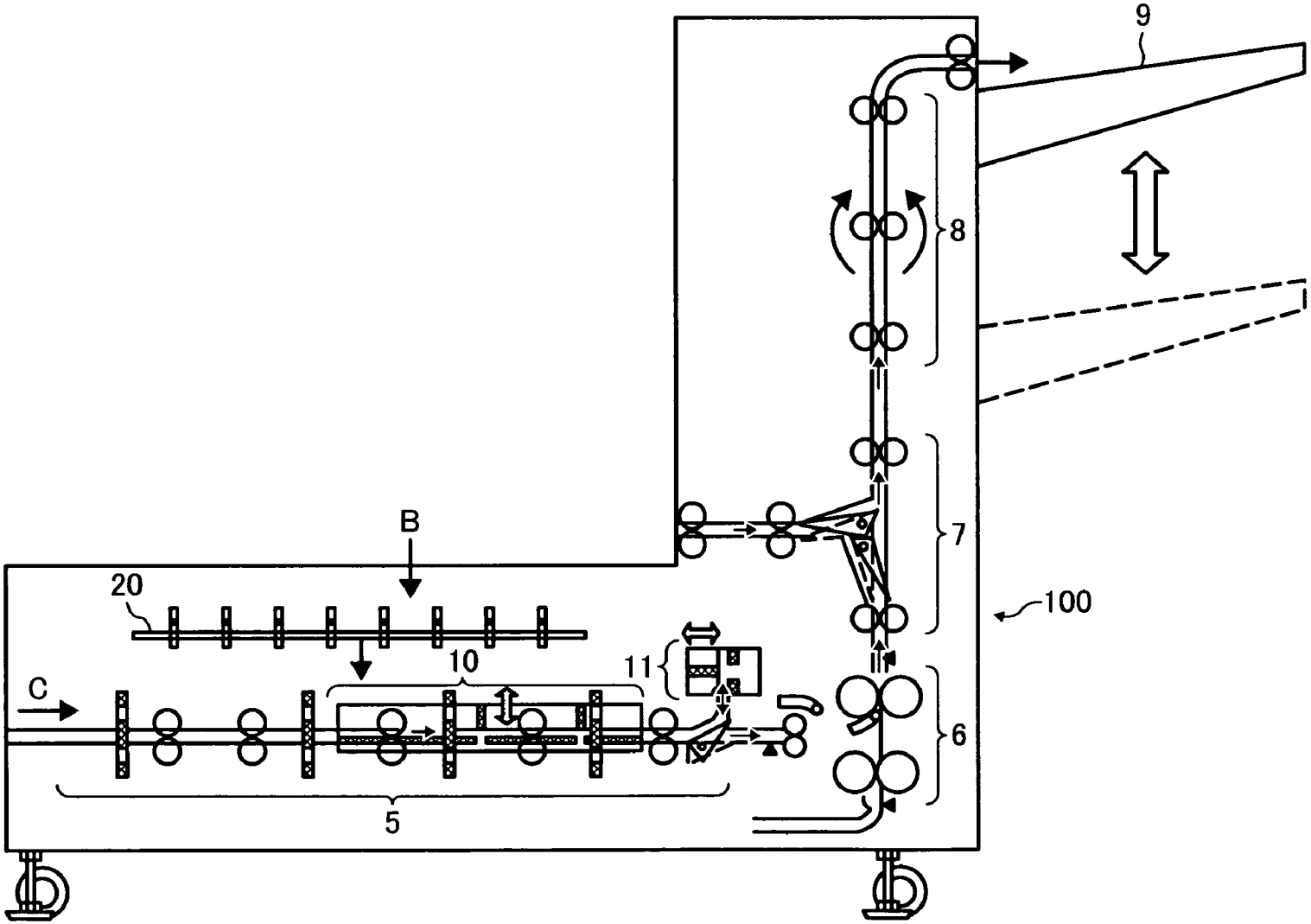
FIG. 2 is a sectional front view (according to an example embodiment of the present invention) of the sheet processing apparatus shown in FIG. 1.

FIG. 2 is a sectional front view of the sheet processing apparatus 100. The sheet processing apparatus 100 further includes an entrance roller 20. The switcher 5 includes a horizontal punch unit 10 and/or a vertical punch unit 11.

After the accordion folder 4 (depicted in FIG. 1) folds the sheet P bearing the toner image, the accordion folder 4 feeds the sheet P in a direction B (i.e., a direction A depicted in FIG. 1) toward the entrance roller 20. The entrance roller 20 feeds the sheet P onto the switcher 5. The switcher 5 turns the sheet conveyance direction of the sheet P by about 90 degrees, so as to feed the sheet P in a direction C. The horizontal punch unit 10 and the vertical punch unit 11 punch a hole in the sheet P.

Figure 3:
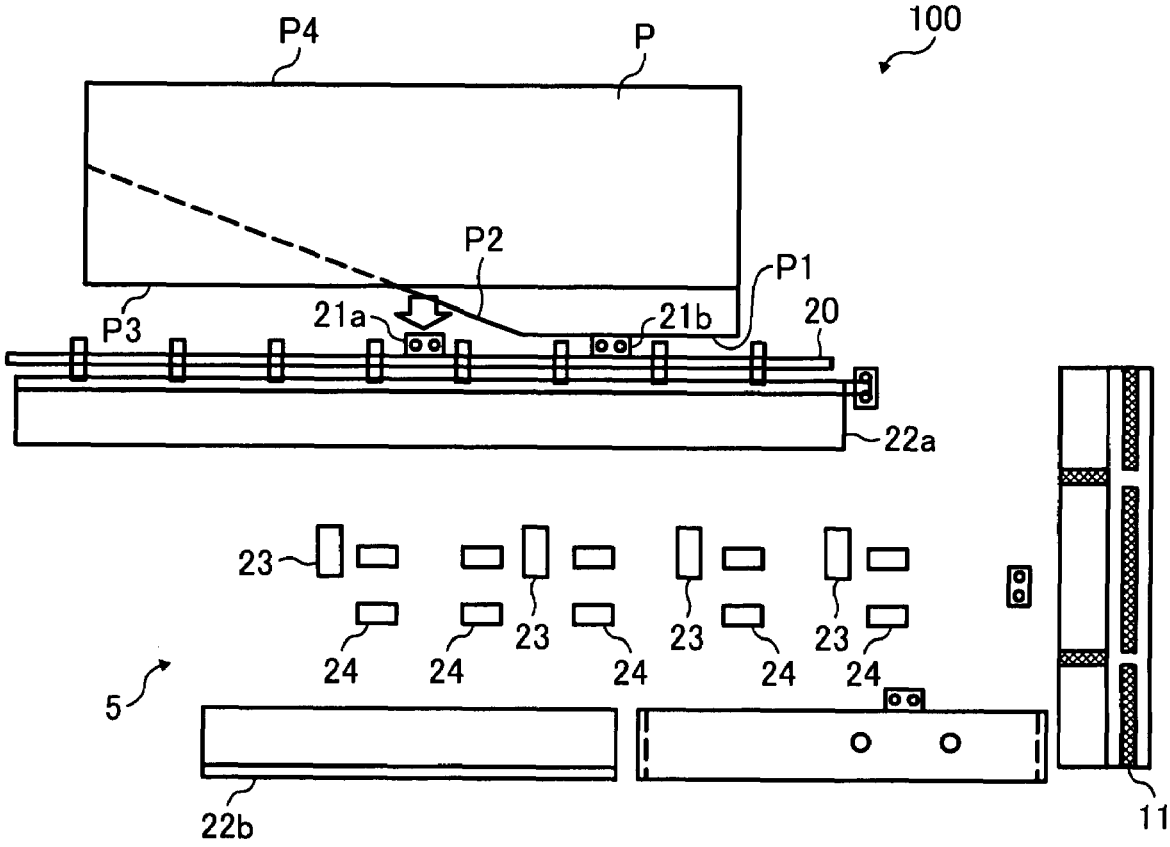
FIG. 3 is a plane view (according to an example embodiment of the present invention) of a switcher of the sheet processing apparatus shown in FIG. 1.

FIG. 3 is a plane view of the switcher 5 before a sheet P enters the switcher 5. As illustrated in FIG. 3, the sheet processing apparatus 100 further includes an entrance sensor 21*a* and/or a corner folding entrance sensor 21*b*. The switcher 5 further includes an upstream jogger fence 22*a*, a downstream jogger fence 22*b*, a plurality of feeders 23, and/or a plurality of feeding rollers 24.

The entrance sensor 21*a* and the corner folding entrance sensor 21*b* are disposed upstream from the entrance roller 20 in the sheet conveyance direction. The entrance sensor 21*a* detects the foremost edge portion P2 of a sheet P, of which corner is folded. The corner folding entrance sensor 21*b* detects a foremost edge portion P1 of a sheet P, of which corner is not folded. A corner of a sheet P is folded along a broken line as illustrated in FIG. 3.

The upstream jogger fence 22*a*, serving as an aligning member, and the downstream jogger fence 22*b* move forward and backward in the sheet conveyance direction so as to align the sheet P fed by the entrance roller 20 in the sheet conveyance direction, or in the direction perpendicular to the sheet conveyance direction when the conveyance direction of the sheet P changes. According to this non-limiting example embodiment, the sheet P discharged from the entrance roller 20 falls onto various positions in the switcher 5. Thus, the sheet P is skewed with respect to the sheet conveyance direction. To address this problem, the upstream jogger fence 22*a* aligns the sheet P discharged from the entrance roller 20 in the sheet conveyance direction. When the conveyance direction of the sheet P changes, the upstream jogger fence 22*a* aligns the sheet P in the direction perpendicular to the sheet conveyance direction.

When a corner of the sheet P is folded, the foremost edge portion P1 protrudes from a head P3 of the sheet P further than the foremost edge portion P2 in the sheet conveyance direction. In other words, the foremost edge portion P2 is not parallel to a tail edge P4. Therefore, when the downstream jogger fence 22*b* disposed downstream from the upstream jogger fence 22*a* in a sheet discharging direction moves closer to the sheet P, the sheet P may be skewed. To address this problem, the feeders 23 feed back (or force) the sheet P toward the upstream jogger fence 22*a* disposed upstream from the downstream jogger fence 22*b* in the sheet discharging direction. Thus, the upstream jogger fence 22*a* contacts an edge of the sheet P (i.e., the tail edge P4 of the sheet P in the sheet discharging direction) to align the sheet P in the sheet discharging direction.

The feeding rollers 24, serving as conveying members, feed the sheet P fed by the feeders 23 toward the cross folder 6 (depicted in FIG. 2).

Figure 4:
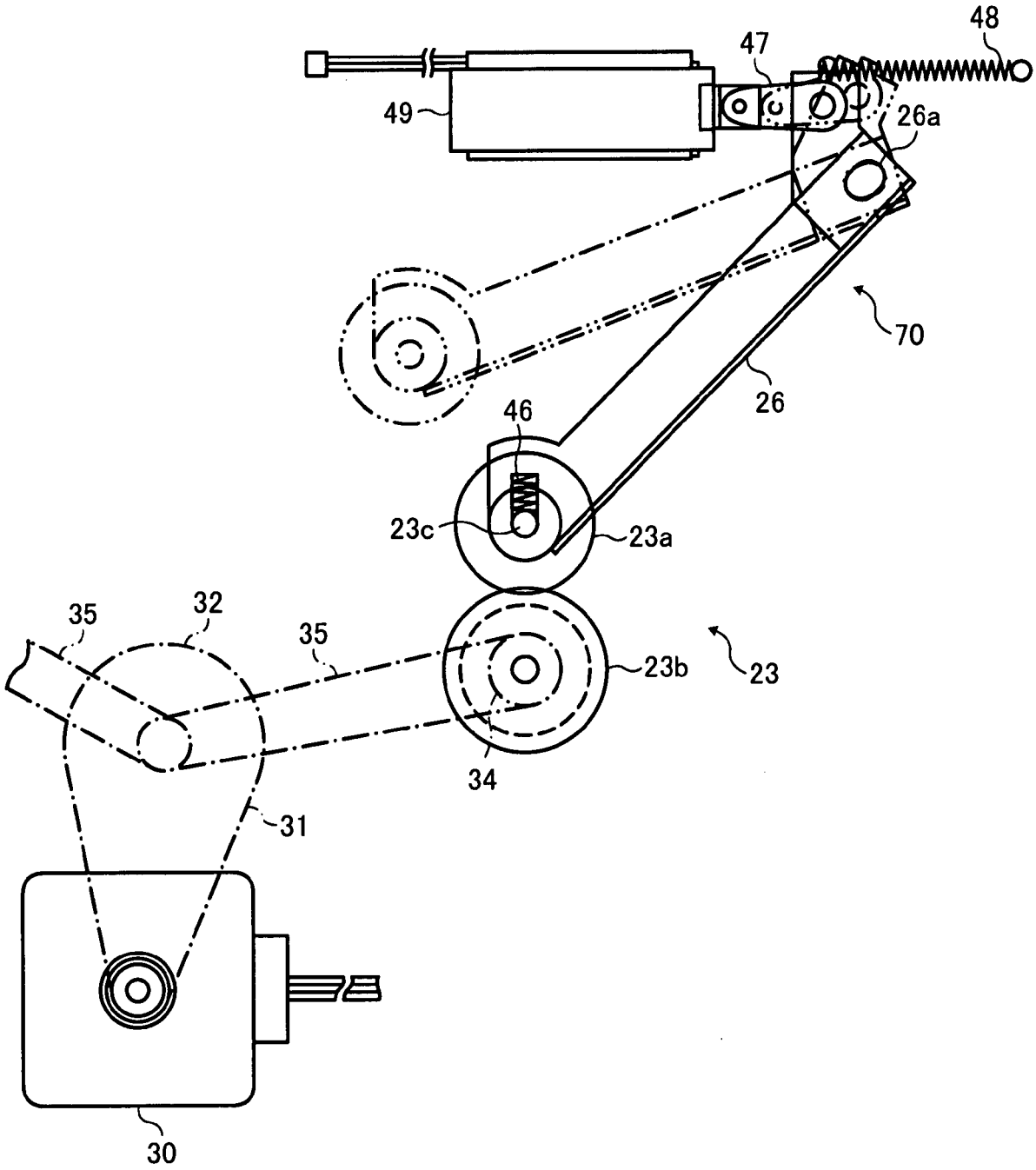
FIG. 4 is a sectional view (according to an example embodiment of the present invention) of a feed-back roller of the switcher shown in FIG. 3.

As illustrated in FIG. 4, the feeder 23 includes a driving feed-back roller 23*b*, a driven feed-back roller 23*a*, a vertical conveying motor 30, a driving belt 31, a pulley 32, a driving belt 35, a pulley 34, an axis 26*a*, a moving mechanism 70, an axis 23*c*, a pressing spring 46, and/or a coupling 47. The moving mechanism 70 includes a vertical conveying arm 26, a feed-back spring 48, and/or a solenoid 49.

The driving feed-back roller 23*b* faces a back surface of a sheet P. The driven feed-back roller 23*a* faces a top surface of a sheet P. The driving feed-back roller 23*b* and the driven feed-back roller 23*a* form a roller pair for feeding back a sheet P. The vertical conveying motor 30 generates a driving force. The driving force is transmitted to the driving feed-back roller 23*b* via the driving belt 31, the pulley 32, the driving belt 35, and the pulley 34. Thus, the driving feed-back roller 23*b* rotates to feed back a sheet P.

The axis 26*a* supports one end of the vertical conveying arm 26. The axis 23*c* is disposed on the other end (i.e., a free end) of the vertical conveying arm 26. The axis 23*c* rotatably supports the driven feed-back roller 23*a*. The pressing spring 46 applies a pressure to the axis 23*c*. The one end of the vertical conveying arm 26 supported by the axis 26*a* is connected to a driving shaft (not shown) of the solenoid 49 via the coupling 47. The feed-back spring 48 continuously applies an elastic force to the driving shaft of the solenoid 49, so that the elastic force separates the driven feed-back roller 23*a* from the driving feed-back roller 23*b*. Namely, when the solenoid 49 is powered on, the driven feed-back roller 23*a* directly or indirectly contacts the driving feed-back roller 23*b*. Thus, the driving feed-back roller 23*b* transmits the driving force transmitted from the vertical conveying motor 30 to a sheet P.

Figure 5:
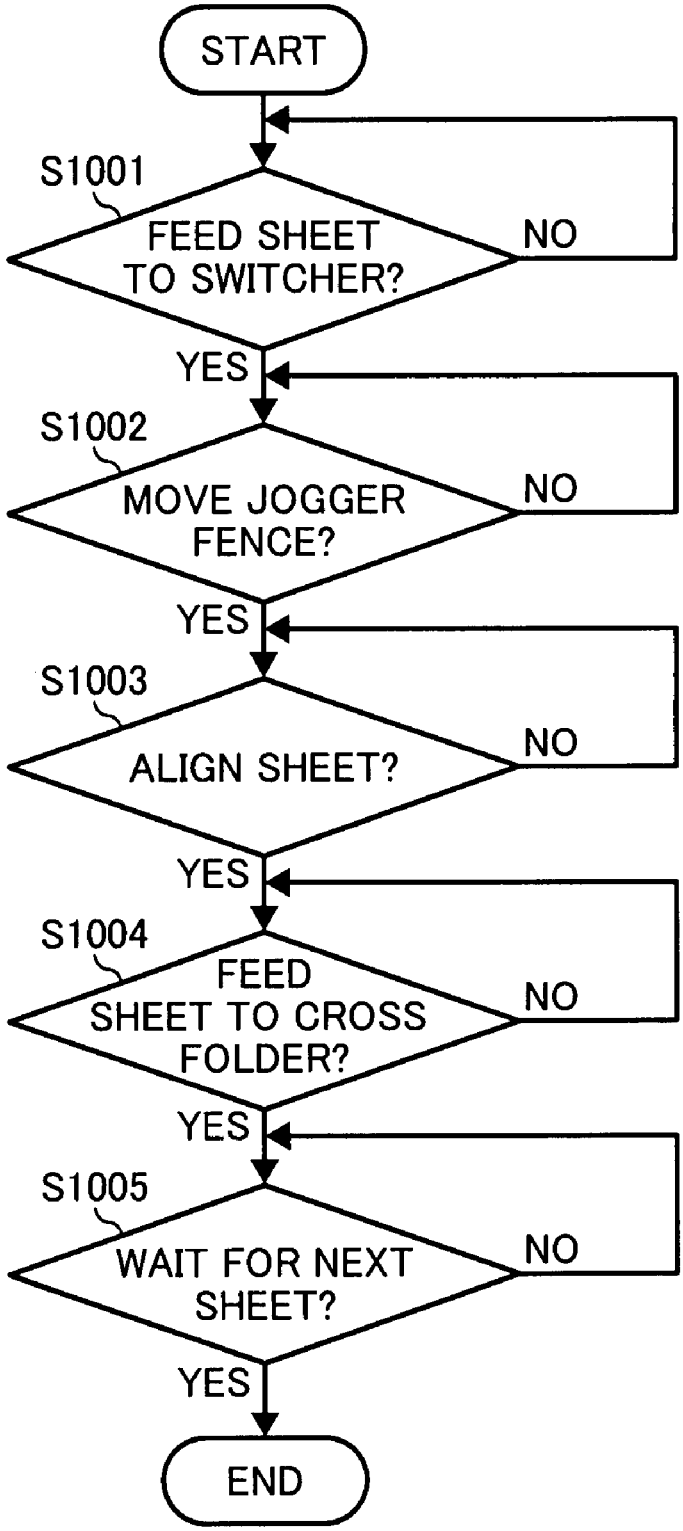
FIG. 5 is a flowchart (according to an example embodiment of the present invention) illustrating operations of the switcher shown in FIG. 3 for aligning and conveying an accordion-folded sheet.
Figure 6:
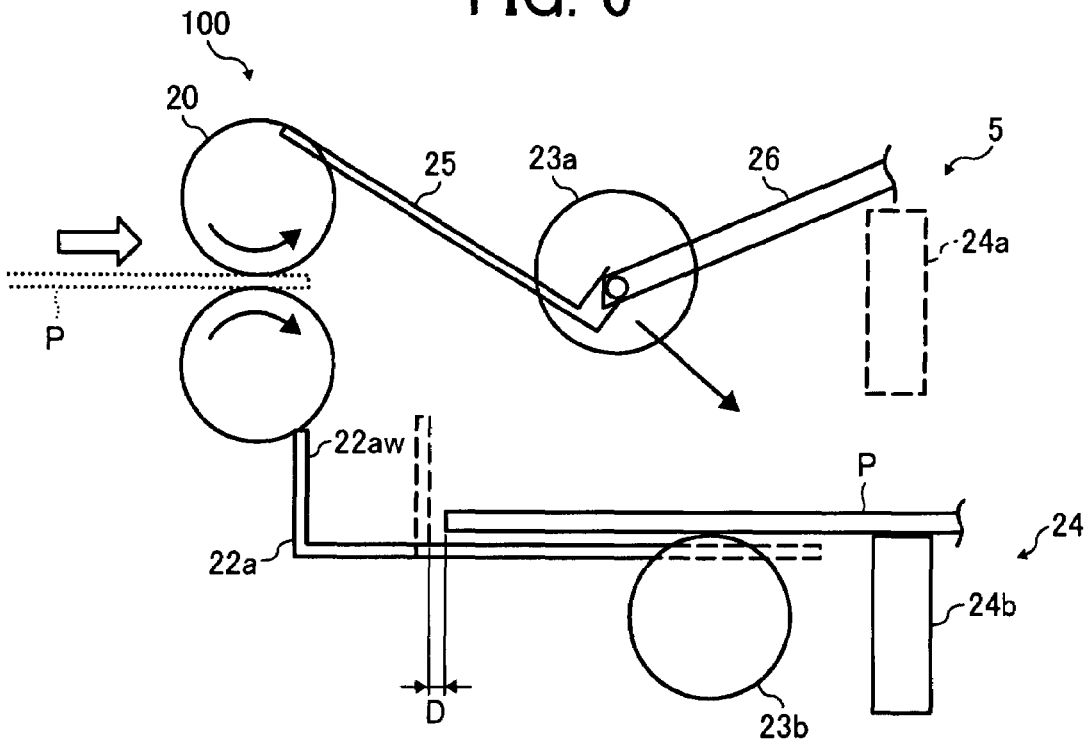
FIG. 6 is a sectional view (according to an example embodiment of the present invention) of the switcher shown in FIG. 3 before a feed-back operation.
Figure 7:
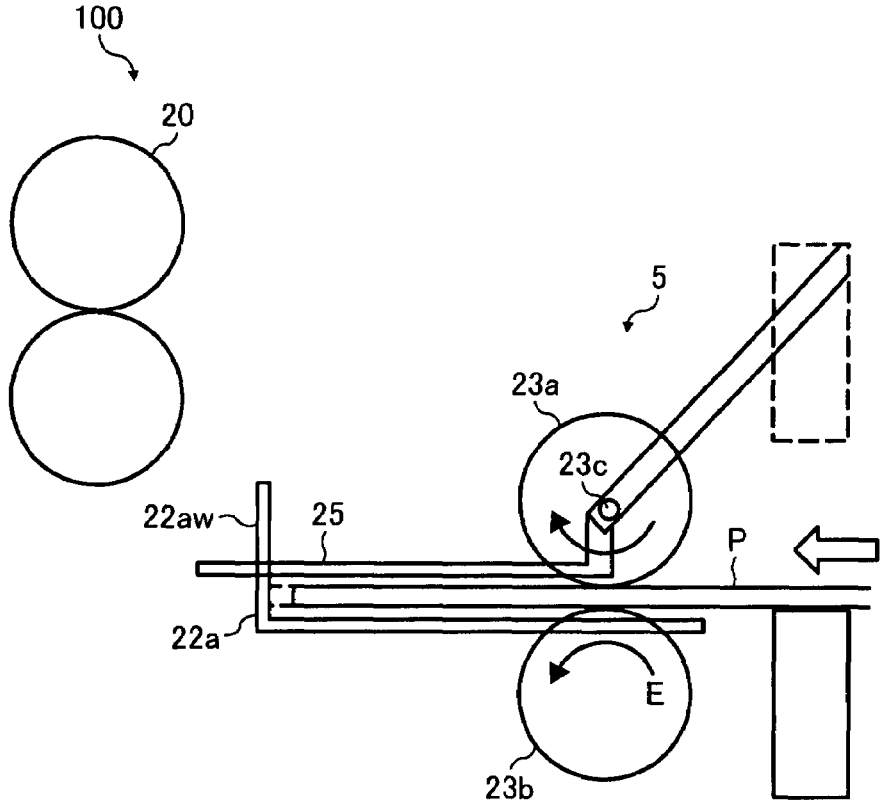
FIG. 7 is a sectional view (according to an example embodiment of the present invention) of the switcher shown in FIG. 3 during a feed-back operation.
Figure 8:
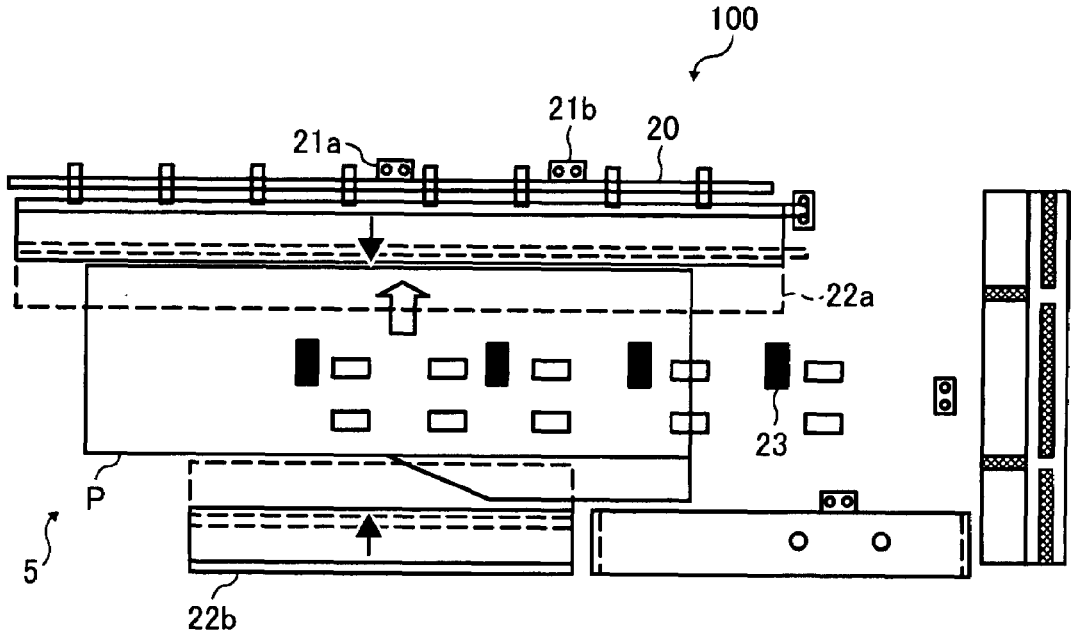
FIG. 8 is a plane view (according to an example embodiment of the present invention) of the switcher shown in FIG. 3 during a feed-back operation.
Figure 9:
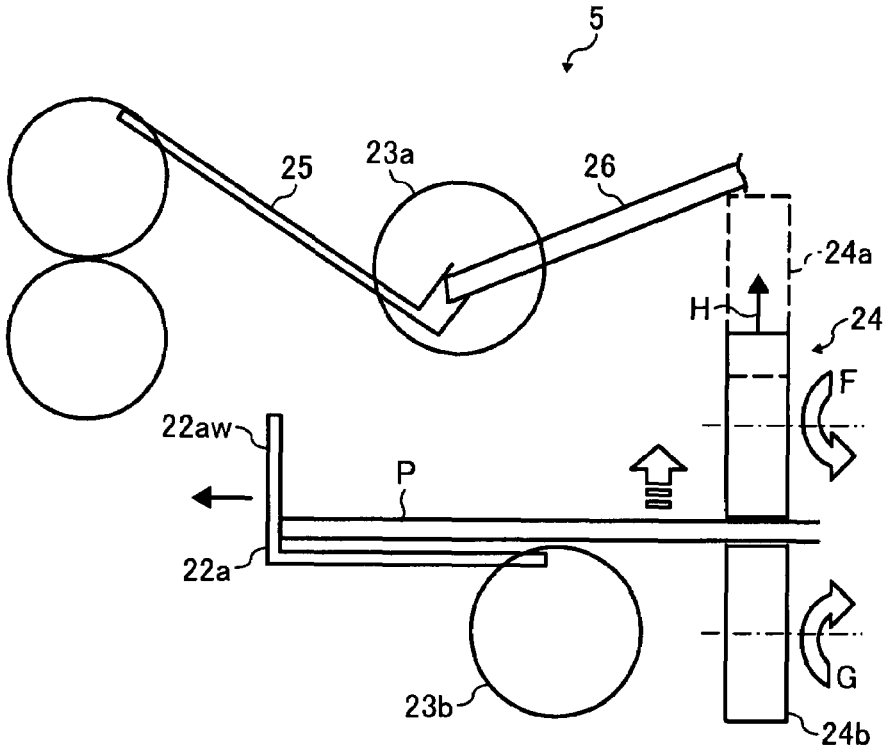
FIG. 9 is a sectional view (according to an example embodiment of the present invention) of the switcher shown in FIG. 3 after a feed-back operation.
Figure 10:
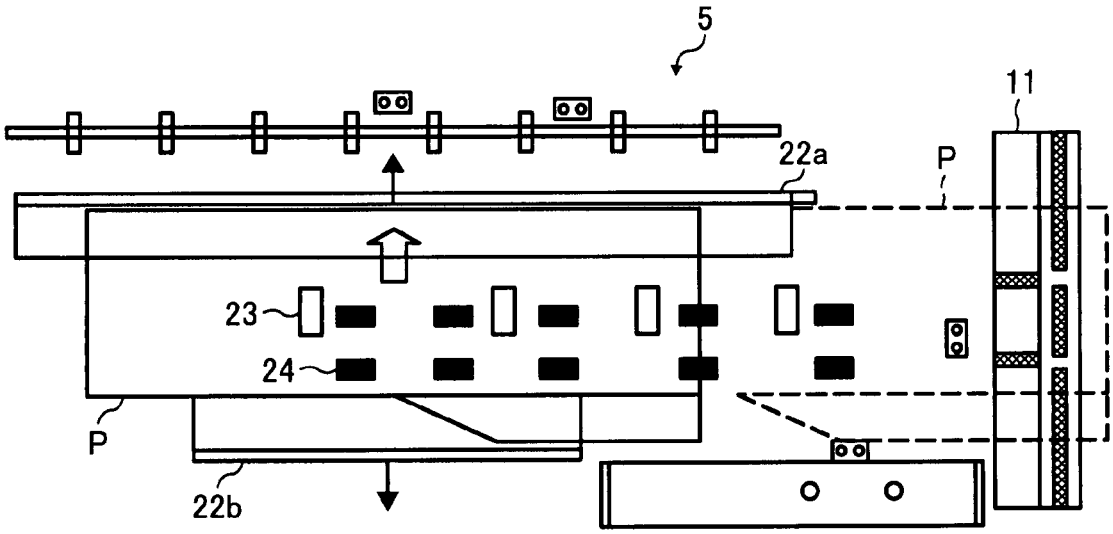
FIG. 10 is a plane view (according to an example embodiment of the present invention) of the switcher shown in FIG. 3 after a feed-back operation.

FIG. 5 is a flowchart illustrating operations of the switcher 5 (depicted in FIG. 2) for aligning and conveying an accordion-folded sheet P. Referring to FIGS. 1 to 10, the following describes procedures of the aligning and conveying operations. FIG. 6 is a sectional view of the switcher 5 before a feed-back operation. FIGS. 7 and 8 illustrate a sectional view and a plane view of the switcher 5 during a feed-back operation, respectively. FIGS. 9 and 10 illustrate a sectional view and a plane view of the switcher 5 after a feed-back operation, respectively As illustrated in FIG. 6, the switcher 5 further includes a guide 25. The feeding roller 24 includes a driven feeding roller 24*a* and/or a driving feeding roller 24*b*. The upstream jogger fence 22*a* includes a wall 22*aw*. The guide 25 guides a sheet P fed by the entrance roller 20 onto the upstream jogger fence 22*a*. The driven feeding roller 24*a* and the driving feeding roller 24*b* feed the sheet P toward the cross folder 6 (depicted in FIG. 2). The wall 22*aw* contacts the tail edge of the sheet P in the sheet conveyance direction to align the sheet P.

As illustrated in FIG. 5, in step S1001, the head of a sheet P (depicted in FIG. 3) positioned upstream from the entrance roller 20 (depicted in FIG. 3) in the sheet conveyance direction enters a nip formed by a roller pair of the entrance roller 20 (depicted in FIG. 6). Namely, the sheet P enters from the accordion folder 4 (depicted in FIG. 1) to the switcher 5 (depicted in FIG. 1). When the controller 101 (depicted in FIG. 1) determines that the sheet P enters the switcher 5 (i.e., if YES is selected in step S1001), the upstream jogger fence 22*a* (depicted in FIG. 6) moves from a standby position to a position illustrated in a broken line in FIG. 6 so that a space D is provided between the tail edge of the sheet P discharged onto the upstream jogger fence 22*a* and the wall 22*aw* of the upstream jogger fence 22*a* facing the tail edge of the sheet P, in step S1002. The entrance sensor 21*a* or the corner folding entrance sensor 21*b* (depicted in FIG. 3) detects a length of the sheet P in the sheet conveyance direction and the space D is calculated based on the detected length of the sheet P.

As illustrated in FIG. 6, the guide 25 is slanted with respect to the sheet P nipped by the entrance roller 20. When the entrance roller 20 feeds the sheet P onto the switcher 5, the guide 25 contacts the head of the fed sheet P to guide the sheet P onto the upstream jogger fence 22*a* Thus, the sheet P is stably discharged from the entrance roller 20 onto the upstream jogger fence 22*a*. The solenoid 49 (depicted in FIG. 4) is turned off and thereby the driven feed-back roller 23*a* separates from the driving feed-back roller 23*b*. According to this non-limiting example embodiment, the sheet P is conveyed based on the center length of the sheet P in the direction perpendicular to the sheet conveyance direction. Therefore, the position of the upstream jogger fence 22*a* illustrated in the broken line in FIG. 6 is determined based on the center length of the sheet P. The driven feeding roller 24*a* and the driving feeding roller 24*b* feed the sheet P toward the cross folder 6 (depicted in FIG. 2).

When the upstream jogger fence 22*a* moves to the position illustrated in the broken line in FIG. 6 (i.e., if YES is selected in step S1002 in FIG. 5), the solenoid 49 (depicted in FIG. 4) is turned on and thereby the driven feed-back roller 23*a* and the guide 25 move downward as illustrated in FIG. 7. Simultaneously, the vertical conveying motor 30 (depicted in FIG. 4) is turned on and thereby the driving feed-back roller 23*b* rotates in a rotating direction E to cause the tail edge of the sheet P to contact the wall 22*aw* of the upstream jogger fence 22*a* facing the tail edge of the sheet P, as illustrated in FIG. 7, in step S1003 in FIG. 5. Thus, the upstream jogger fence 22*a* aligns the sheet P in the sheet conveyance direction. Namely, even when the sheet P is skewed when discharged onto the switcher 5, the sheet P is aligned by the upstream jogger fence 22*a* in the sheet conveyance direction. The driven feed-back roller 23*a* of each of the feeders 23, which is solid-filled in FIG. 8, is pressed. Thus, as illustrated in FIG. 7, the driving feed-back roller 23*b* contacts the sheet P and transmits a driving force transmitted from the vertical conveying motor 30 (depicted in FIG. 4) to the sheet P. The guide 25 regulates the top surface of the sheet P to prevent the sheet P from buckling when the sheet P is fed back toward the wall 22*aw* by the driving feed-back roller 23*b* and the driven feed-back roller 23*a*.

As illustrated in FIG. 9, when the sheet P is aligned by the upstream jogger fence 22*a* in the sheet conveyance direction (i.e., if YES is selected in step S1003 in FIG. 5), the solenoid 49 (depicted in FIG. 4) is turned off and thereby the driven feed-back roller 23*a* moves upward. The driven feeding roller 24*a* moves downward to press the sheet P toward the driving feeding roller 24*b*. In FIG. 10, each of the feeding rollers 24 in which the driven feeding roller 24*a* presses the sheet P toward the driving feeding roller 24*b* is solid-filled. As illustrated in FIG. 9, in step S1004 (depicted in FIG. 5), the driven feeding roller 24*a* and the driving feeding roller 24*b* rotate in rotating directions F and G, respectively, to feed the sheet P toward the cross folder 6 (depicted in FIG. 2). When the driven feeding roller 24*a* and the driving feeding roller 24*b* finish feeding the sheet P toward the cross folder 6 (i.e., if YES is selected in step S1004 in FIG. 5), the driven feeding roller 24*a* moves upward in a direction H. The upstream jogger fence 22*a* returns to the standby position to become ready for aligning a next sheet P in step S1005 in FIG. 5.

As illustrated in FIG. 2, a sheet P is conveyed toward the cross folder 6 based on the center line of the sheet P in the direction perpendicular to the sheet conveyance direction. The reversing device 7 and the turning device 8 perform processing based on the center line of the sheet P in the direction perpendicular to the sheet conveyance direction. In the switcher 5, the horizontal punch unit 10 and the vertical punch unit 11 punch a hole in the sheet P as needed in accordance with an instruction sent from the image forming apparatus 200 (depicted in FIG. 1).

As illustrated in FIG. 3, when a corner of a sheet P is folded, a limited part of the foremost edge of the sheet P in the sheet conveyance direction can contact the downstream jogger fence 22*b* when the sheet P is discharged onto the switcher 5. Therefore, if the downstream jogger fence 22*b* and the upstream jogger fence 22*a* simultaneously contact the foremost edge and the tail edge of the sheet P in the sheet conveyance direction, respectively, the sheet P may not be properly aligned in the sheet conveyance direction. However, according to this non-limiting example embodiment, the feeders 23 feed back the sheet P toward the upstream jogger fence 22*a* so that the tail edge of the sheet P in the sheet conveyance direction, which is not folded, contacts the upstream jogger fence 22*a*. Thus, the sheet P can be properly aligned in the sheet conveyance direction.

The upstream jogger fence 22*a* aligns the sheet P based on the center line of the sheet P in the sheet conveyance direction. Even when the sheet P varies in size, the sheet P is aligned based on the center line of the sheet P in the sheet conveyance direction. Thus, when the sheet P is conveyed to the cross folder 6, the reversing device 7, and the turning device 8 (depicted in FIG. 2), the cross folder 6, the reversing device 7, and the turning device 8 can properly perform processing.

In the feeders 23 and the feeding rollers 24, the driven feed-back roller 23*a* and the driven feeding roller 24*a* (depicted in FIG. 6) retreat from the sheet P, while the driven feed-back roller 23*a* and the driven feeding roller 24*a* do not perform feed-back and feed operations, respectively. Thus, the driven feed-back roller 23*a* and the driven feeding roller 24*a* may not disturb conveyance of the sheet P, resulting in smooth conveyance of the sheet P.

Figure 11:
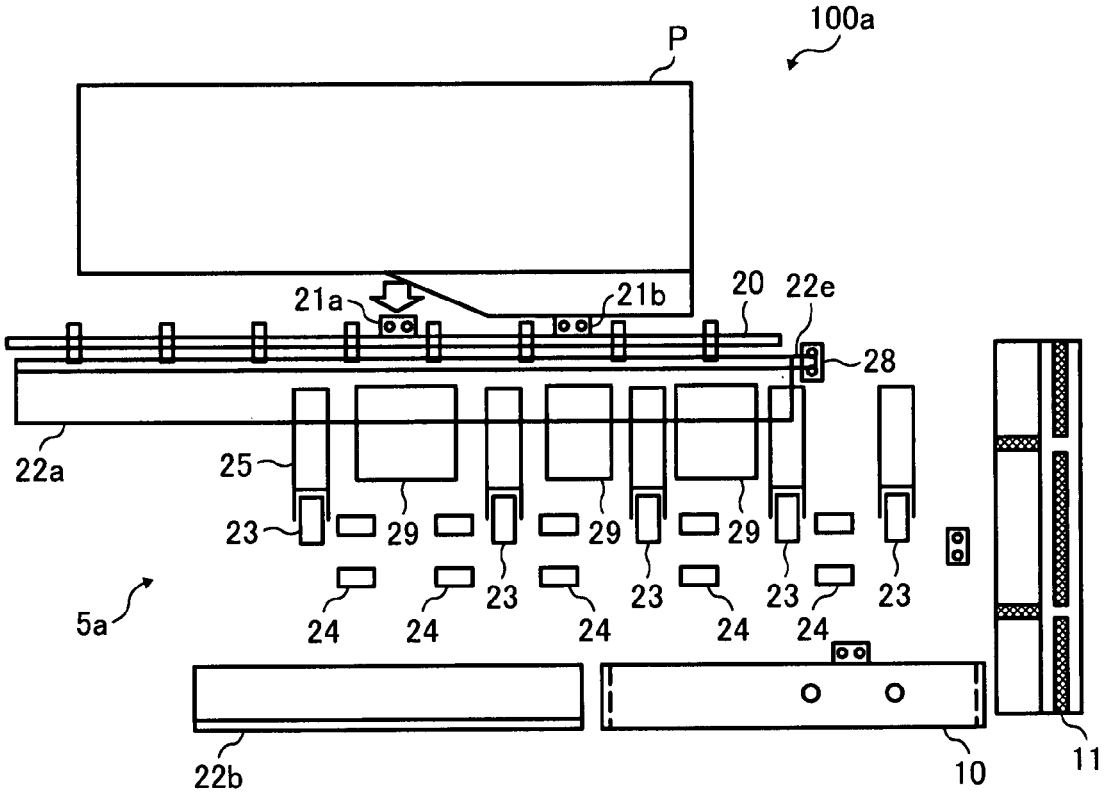
FIG. 11 is a plane view of a switcher of a sheet processing apparatus according to another example embodiment of the present invention.

Referring to FIGS. 11 to 37, the following describes a sheet processing apparatus 100*a* according to another example embodiment. As illustrated in FIG. 11, the sheet processing apparatus 100*a* includes the entrance roller 20 and/or a switcher 5*a*. The switcher 5*a* includes a home position shade 22*e*, a home position sensor 28, and/or a guide 29.

The switcher 5*a*, serving as a sheet aligner, switches a sheet conveyance direction of a sheet P by tuning a direction in which the sheet P is conveyed by about 90 degrees, and feeds the sheet P toward the cross folder 6 (depicted in FIG. 2).

The home position shade 22*e* is fixed to the upstream jogger fence 22*a*. The home position shade 22*e* shades the home position sensor 28 in a standby position to turn on the home position sensor 28. When the upstream jogger fence 22*a* and the downstream jogger fence 22*b* move, the home position sensor 28 is turned off. The guide 29 guides a sheet P fed by the entrance roller 20 onto the upstream jogger fence 22*a*. The other elements of the sheet processing apparatus 100*a* are common to the sheet processing apparatus 100.

Figure 12:
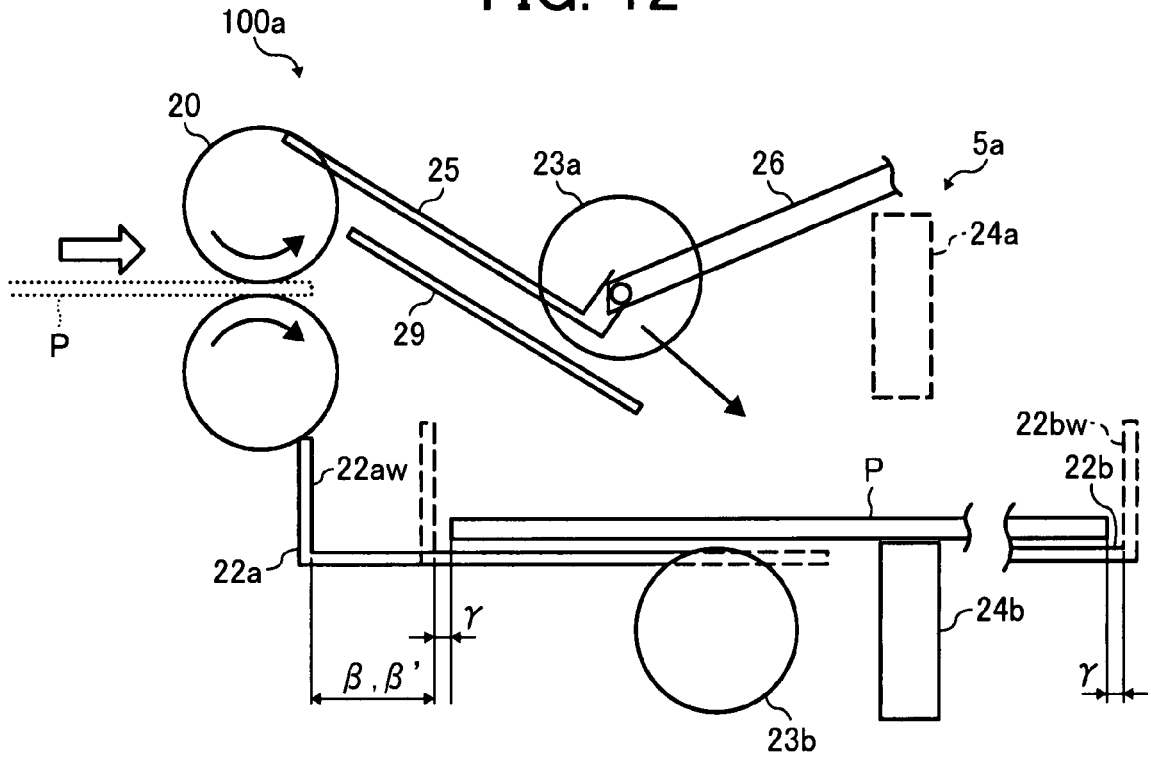
FIG. 12 is a sectional view (according to another example embodiment of the present invention) of the switcher shown in FIG. 11 before a feed-back operation.

FIG. 12 is a sectional view of the switcher 5*a*. As illustrated in FIG. 12, the downstream jogger fence 22*b* includes a wall 22*bw* for contacting the foremost edge of a sheet P in a sheet conveyance direction to align the sheet P. A corner of a sheet P is folded by the corner folder 3 (depicted in FIG. 1) and the sheet P is accordion-folded by the accordion folder 4 (depicted in FIG. 1) in the sheet conveyance direction. The entrance roller 20 rotates to feed the sheet P toward the switcher 5*a*. For example, the foremost edge of the sheet P touches the guide 29 and is guided by the guide 29 onto the upstream jogger fence 22*a* and the downstream jogger fence 22*b*. The upstream jogger fence 22*a* disposed upstream from the downstream jogger fence 22*b* in the sheet conveyance direction is positioned under the entrance roller 20 as illustrated in a solid line in FIG. 12 to be ready for receiving the sheet P fed by the entrance roller 20.

Figure 13:
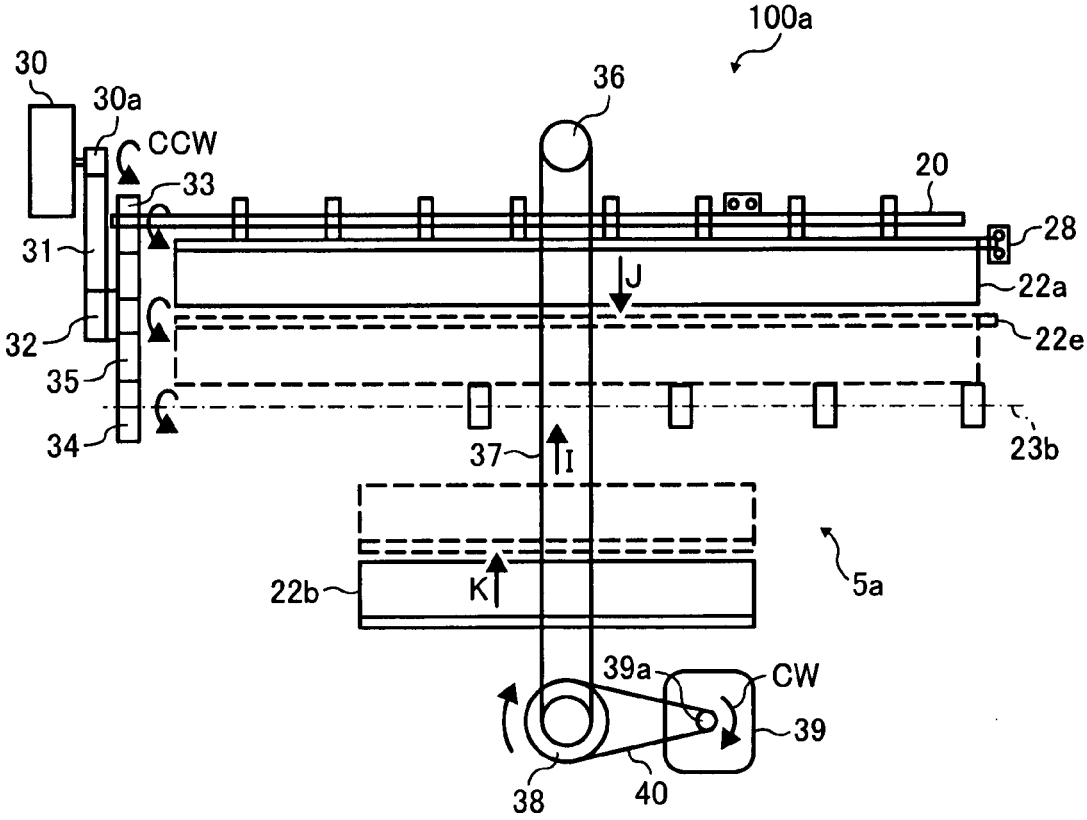
FIG. 13 is a plane view (according to another example embodiment of the present invention) of the switcher shown in FIG. 11 before a feed-back operation.
Figure 14:
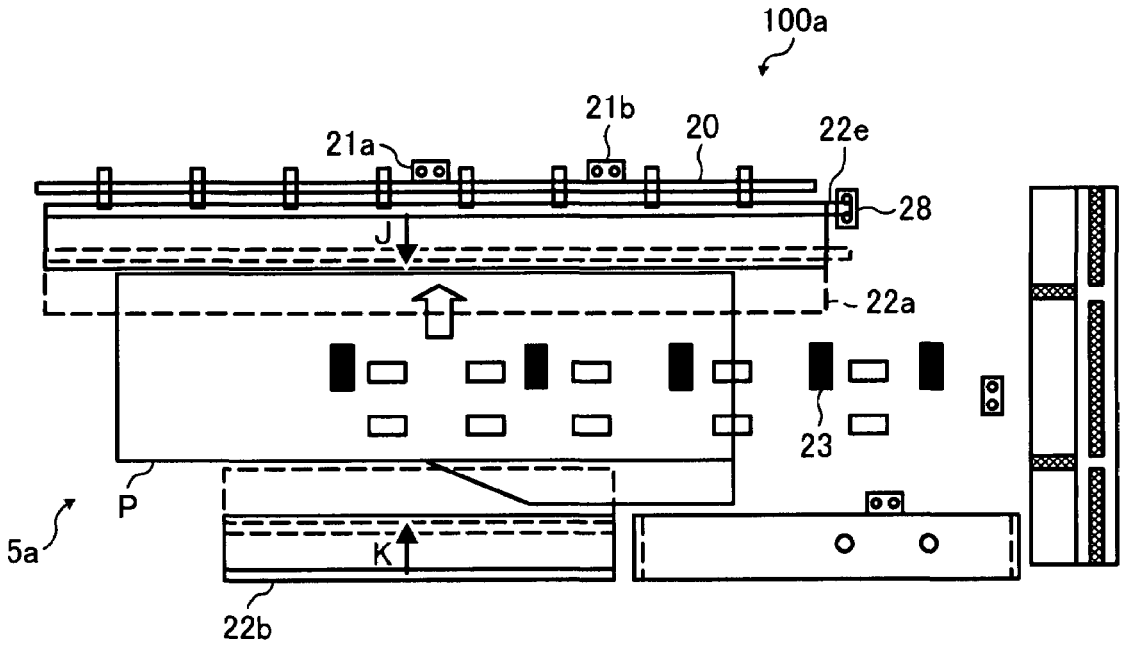
FIG. 14 is a plane view (according to another example embodiment of the present invention) of the switcher shown in FIG. 11 during a feed-back operation.

FIGS. 13 and 14 illustrate a plane view of the switcher 5*a*. As illustrated in FIG. 13, the switcher 5*a* further includes a jogger motor 39, a jogger motor pulley 39*a*, a driving belt 40, pulleys 38 and 36, a driving belt 37, a vertical conveying motor pulley 30*a*, and/or a pulley 33.

The jogger motor 39 rotates in a rotating direction CW and generates a driving force. The driving force is transmitted to the driving belt 37 via the jogger motor pulley 39*a*, the driving belt 40, and the pulleys 38 and 36. Thus, the driving belt 37 rotates in a rotating direction I. The driving belt 37 is fixed to the upstream jogger fence 22*a* and the downstream jogger fence 22*b*. Therefore, when the driving belt 37 rotates in the rotating direction I, the upstream jogger fence 22*a* and the downstream jogger fence 22*b* move in directions J and K, respectively. Namely, as illustrated in FIG. 14, the upstream jogger fence 22*a* and the downstream jogger fence 22*b* move from a position illustrated in a solid line to a position illustrated in a broken line.

The home position shade 22*e* is fixed to the upstream jogger fence 22*a*. The home position shade 22*e* shades the home position sensor 28 in a standby position to turn on the home position sensor 28. As illustrated in FIG. 13, when the upstream jogger fence 22*a* and the downstream jogger fence 22*b* move, the home position sensor 28 is turned off. The jogger motor 39, driven when the home position sensor 28 is turned off, determines a distance for which the upstream jogger fence 22*a* and the downstream jogger fence 22*b* move. Namely, the upstream jogger fence 22*a* and the downstream jogger fence 22*b* move for a common distance in accordance with rotation of the jogger motor 39. When a common distance is provided between each of the upstream jogger fence 22*a* and the downstream jogger fence 22*b* and a center line in the direction perpendicular to the sheet conveyance direction of the sheet P conveyed in the cross folder 6 and the turning device 8 (depicted in FIG. 2) disposed downstream from the switcher 5*a*, the center line of the sheet P does not vary depending on the size of the sheet P.

Figure 15:
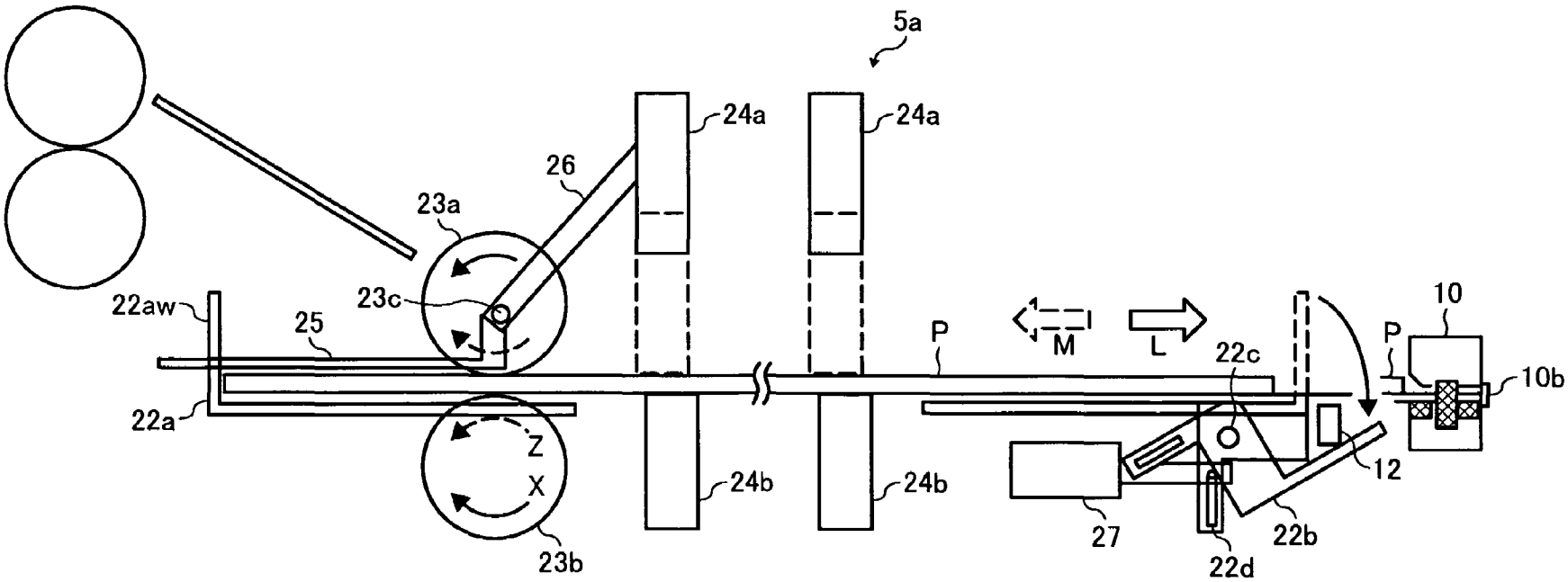
FIG. 15 is a sectional view (according to another example embodiment of the present invention) of the switcher shown in FIG. 11 during a feed-back operation.

FIG. 15 is a sectional view of the switcher 5*a*. The switcher 5*a* further includes an axis 22*c*, a slot 22*d*, a swinging solenoid 27, and/or a horizontal punch head sensor 12. The horizontal punch unit 10 includes a wall 10*b*.

The axis 22*c* rotatably supports the downstream jogger fence 22*b*. The slot 22*d* is provided on the downstream jogger fence 22*b* and engages with the swinging solenoid 27. When the swinging solenoid 27 is turned on, the downstream jogger fence 22*b* rotates around the axis 22*c* to retreat from a sheet conveyance path on which a sheet P is conveyed. The driven feed-back roller 23*a* and the driving feed-back roller 23*b* can feed a sheet P on the upstream jogger fence 22*a* and the downstream jogger fence 22*b* forward and backward in directions L and M. The horizontal punch head sensor 12 is disposed before the horizontal punch unit 10 in the sheet conveyance direction to detect a time when a sheet P stops in the horizontal punch unit 10. When the sheet P conveyed in the direction L contacts the wall 10*b*, the horizontal punch unit 10 punches a hole in the sheet P.

Figure 16:
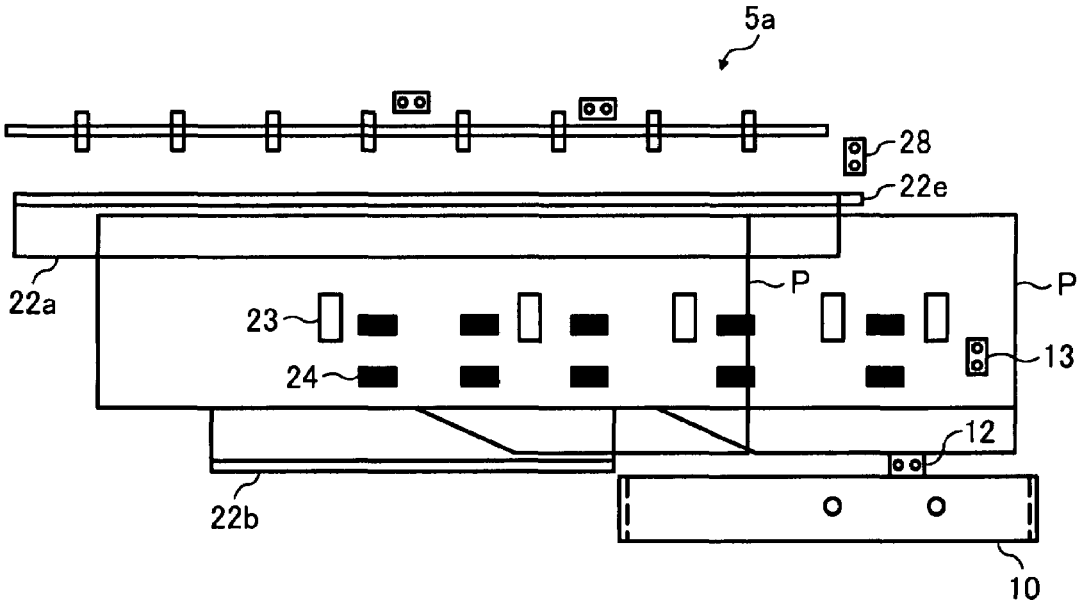
FIG. 16 is a plane view (according to another example embodiment of the present invention) of the switcher shown in FIG. 11 conveying a large size sheet.
Figure 17:
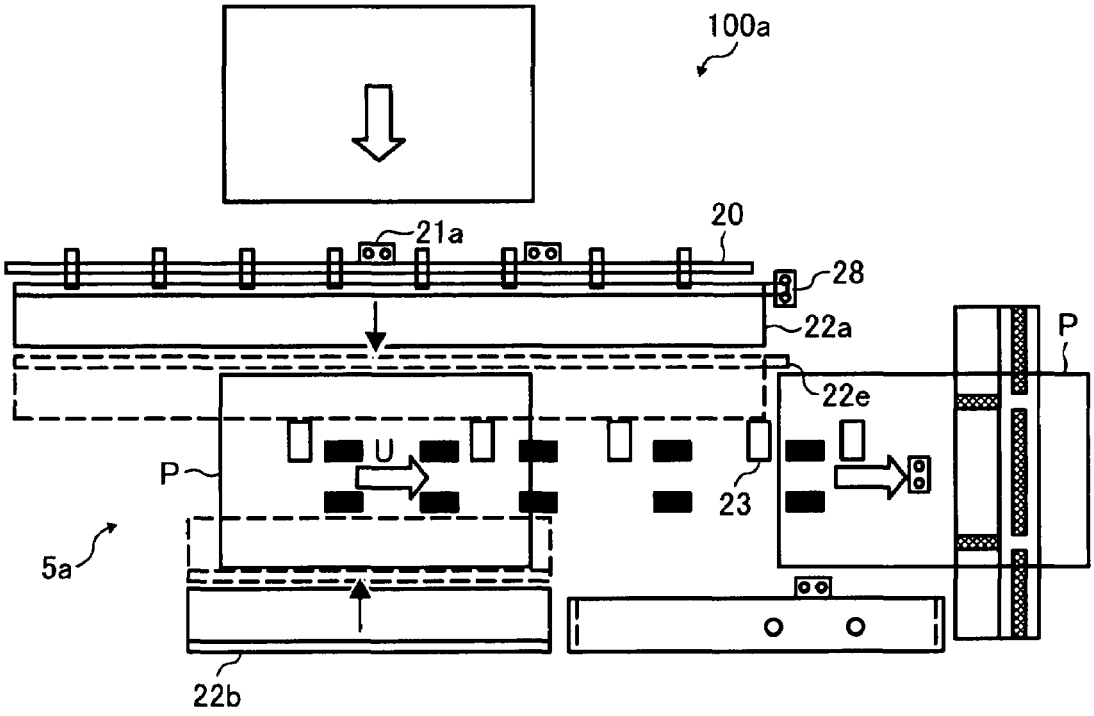
FIG. 17 is a plane view (according to another example embodiment of the present invention) of the switcher shown in FIG. 11 conveying a small size sheet.

FIG. 16 is a plane view of the switcher 5*a* conveying a corner-folded, large size sheet P. FIG. 17 is a plane view of the switcher 5*a* conveying a small size sheet P. As illustrated in FIG. 16, the switcher 5*a* further includes a vertical punch head sensor 13. The vertical punch head sensor 13 is disposed before the vertical punch unit 11 (depicted in FIG. 11) in the sheet conveyance direction to detect a time when a sheet P stops in the vertical punch unit 11. As illustrated in FIGS. 16 and 17, the switcher 5*a* includes a plurality of feeders 23 so as to feed sheets P of various sizes and fold types.

Figure 18:
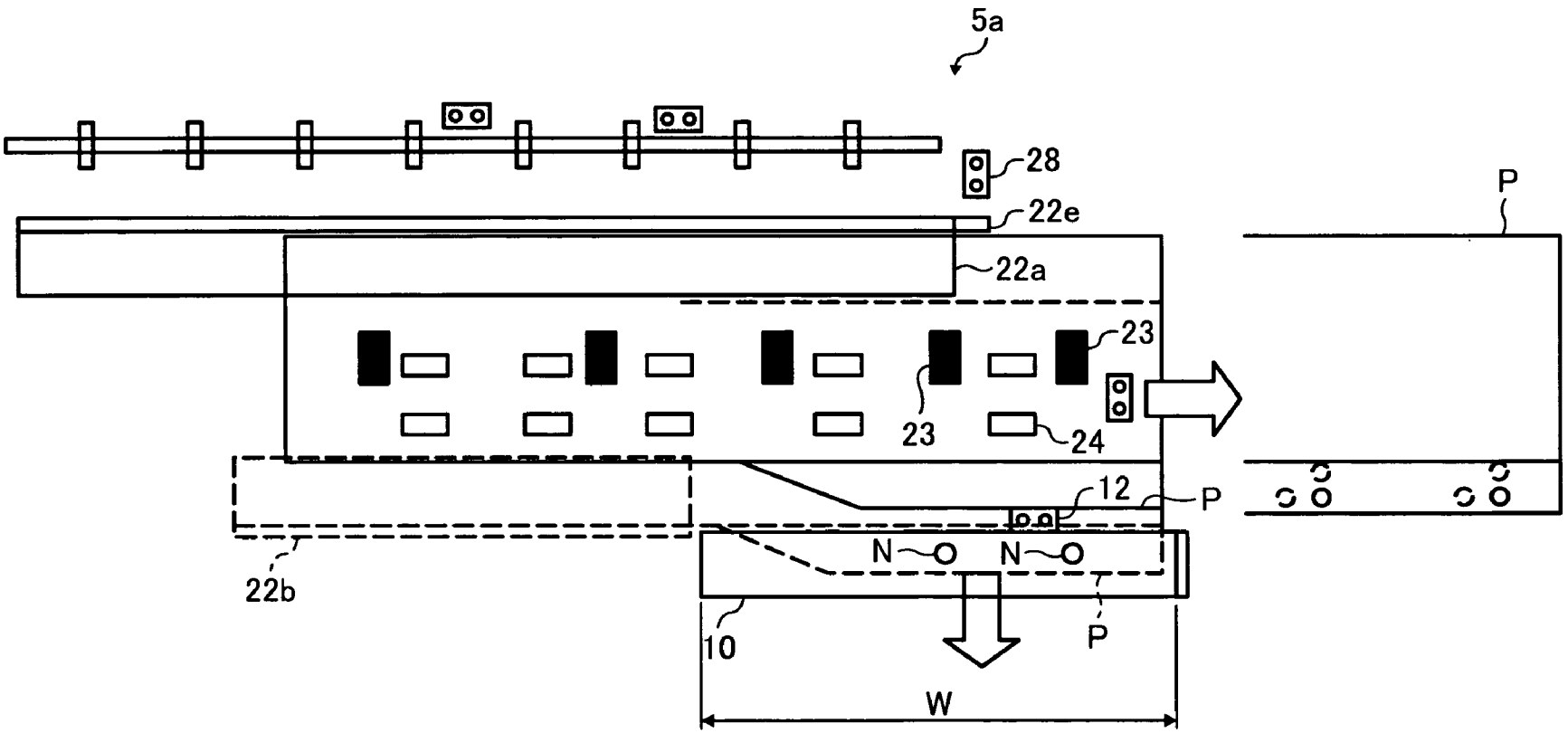
FIG. 18 is a plane view (according to another example embodiment of the present invention) of the switcher shown in FIG. 11 punching a corner-folded, large size sheet.

FIG. 18 is a plane view of the switcher 5*a* punching a corner-folded, large size sheet P. As illustrated in FIG. 18, the feeders 23 oppose holes N punched by the horizontal punch unit 10.

As illustrated in FIG. 12, according to this non-limiting example embodiment, the driven feed-back roller 23*a* and the driving feed-back roller 23*b* are disposed near the upstream jogger fence 22*a*. As illustrated in FIG. 13, the driving feed-back roller 23*b* is fixed on a shaft (not shown) on which the pulley 34 is fixed. The vertical conveying motor 30 generates a driving force. The driving force is transmitted to the driving feed-back roller 23*b* via the vertical conveying motor pulley 30*a*, the driving belt 31, the pulley 32, the driving belt 35, and the pulley 34. Thus, when the vertical conveying motor 30 rotates in a rotating direction CCW, the driving feed-back roller 23*b* rotates in a direction for feeding a sheet P toward the downstream jogger fence 22*b*. When the vertical conveying motor 30 rotates in a rotating direction counter to the rotating direction CCW, the driving feed-back roller 23*b* rotates in a direction for feeding a sheet P toward the upstream jogger fence 22*a*.

The entrance roller 20 is fixed on a shaft (not shown) on which the pulley 33 is fixed. The vertical conveying motor 30 generates a driving force. The driving force is transmitted to the entrance roller 20 via the vertical conveying motor pulley 30*a*, the driving belt 31, the pulley 32, the driving belt 35, and the pulley 33. Thus, when the vertical conveying motor 30 rotates in the rotating direction CCW, the entrance roller 20 rotates in a direction for feeding a sheet P onto the upstream jogger fence 22*a*. As illustrated in FIG. 12, when the entrance roller 20 feeds the sheet P onto the upstream jogger fence 22*a* and the downstream jogger fence 22*b*, the driven feed-back roller 23*a* separates from the driving feed-back roller 23*b* to wait at a standby position at which the driven feed-back roller 23*a* does not touch the sheet P.

As illustrated in FIG. 4, when the vertical conveying motor 30 rotates to cause the driving feed-back roller 23*b* to feed a sheet P, the solenoid 49 is turned on to pull the coupling 47. The vertical conveying arm 26 rotates around the axis 26*a* from a position illustrated in a broken line to a position illustrated in a solid line. Thus, the driven feed-back roller 23*a* attached to the vertical conveying arm 26 via the pressing spring 46 pressingly contacts the driving feed-back roller 23*b*. On the other hand, when the solenoid 49 is turned off to release the coupling, 47, the vertical conveying arm 26 rotates around the axis 26*a* from the position illustrated in the solid line to the position illustrated in the broken line. Thus, the driven feed-back roller 23*a* attached to the vertical conveying arm 26 via the pressing spring 46 separates from the driving feed-back roller 23*b*.

Figure 19:
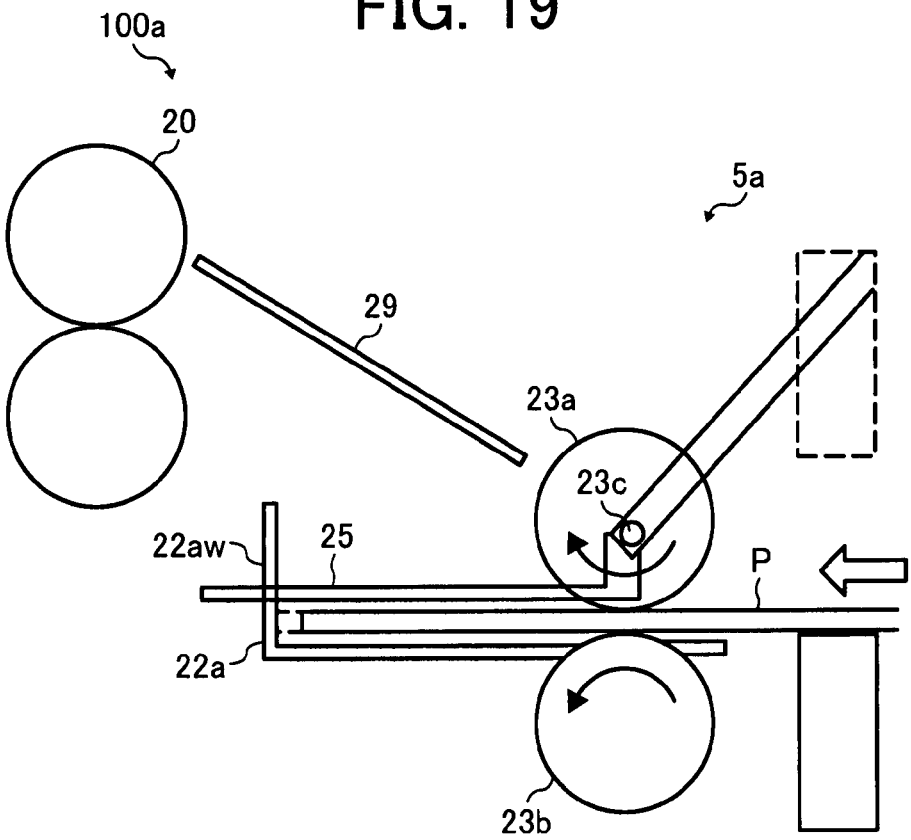
FIG. 19 is a sectional view (according to another example embodiment of the present invention) of the switcher shown in FIG. 11 during a feed-back operation.

FIG. 19 is a sectional view of the switcher 5*a*. As illustrated in FIG. 19, the axis 23*c* rotatably supports the driven feed-back roller 23*a* and the guide 25. Thus, when the driven feed-back roller 23*a* contacts a sheet P, the guide 25 presses the top surface of the sheet P.

As illustrated in FIG. 11, the feeding rollers 24 feed a sheet P conveyed onto the upstream jogger fence 22*a* and the downstream jogger fence 22*b* toward the cross folder 6 (depicted in FIG. 2).

Figure 20:
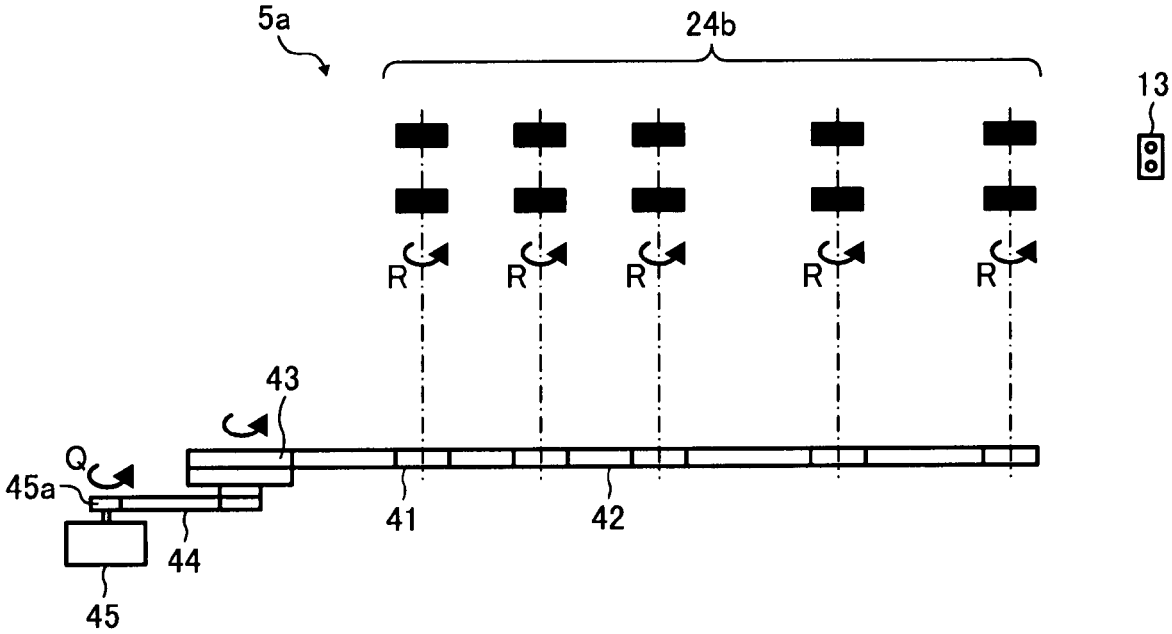
FIG. 20 is a plane view (according to another example embodiment of the present invention) of the switcher shown in FIG. 11 during a feeding operation.

FIG. 20 is a plane view of the switcher 5*a*. As illustrated in FIG. 20, the switcher 5*a* further includes a pulley 41, a horizontal conveying motor 45, a driving belt 42, a pulley 43, a driving belt 44, and/or a horizontal conveying motor pulley 45*a*.

The pulley 41 is fixed on a shaft (not shown) on which the driving feeding roller 24*b* is fixed. The pulley 41 is connected to the horizontal conveying motor 45 via the driving belt 42, the pulley 43, the driving belt 44, and the horizontal conveying motor pulley 45*a*. When the horizontal conveying motor 45 rotates in a rotating direction Q, the driving feeding roller 24*b* rotates in a rotating direction R to feed a sheet P toward the cross folder 6 (depicted in FIG. 2).

Figure 21:
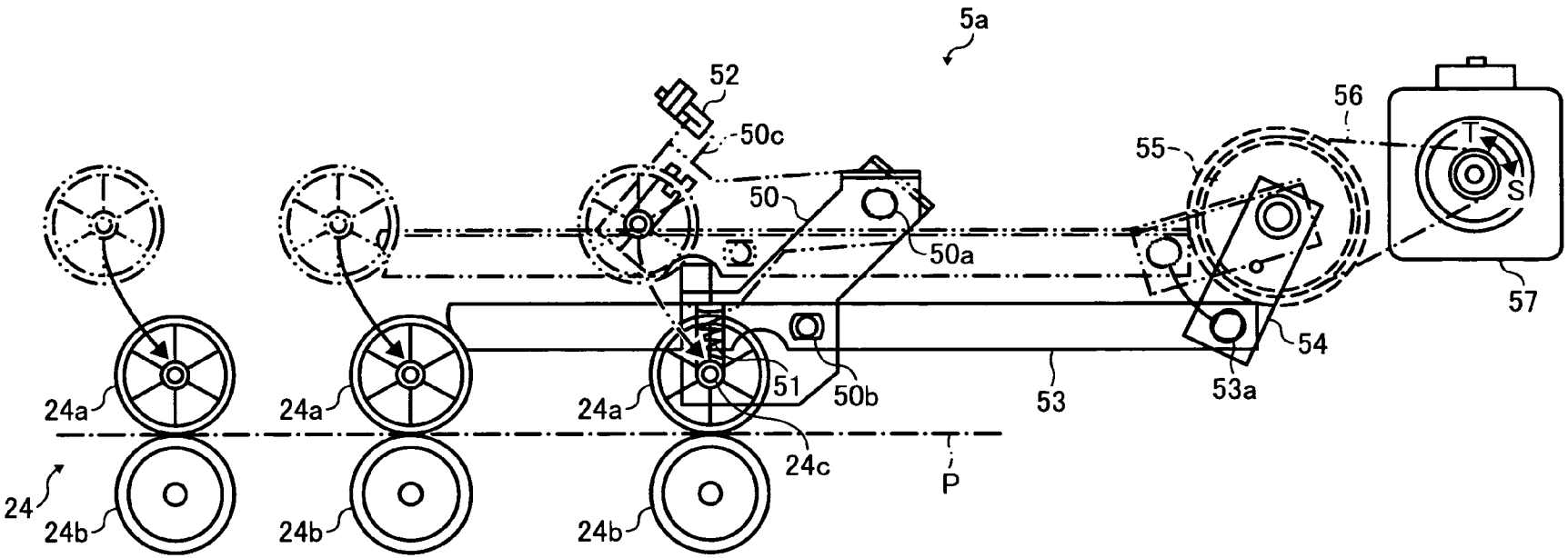
FIG. 21 is a sectional view (according to another example embodiment of the present invention) of a pressing and swinging mechanism of a feeding roller included in the switcher shown in FIG. 11.

FIG. 21 is a sectional view of the switcher 5*a* and illustrates a pressing and swinging mechanism of the feeding roller 24. As illustrated in FIG. 21, the switcher 5*a* further includes a shaft 24*c*, a spring 51, a bracket 50, an axis 50*a*, an axis 50*b*, an arm 53, an axis 53*a*, a swinging lever 54, a pulley 55, a swinging motor 57, a belt 56, a home position shade 50*c*, and/or a home position sensor 52.

The driven feeding roller 24*a* is connected to the bracket 50 via the shaft 24*c* and the spring 51. The bracket 50 supports a plurality of driven feeding rollers 24*a* and swings around the axis 50*a* between a position (i.e., a standby position) illustrated in a broken line and a position illustrated in a solid line. The axis 50*b* rotatably supports the bracket 50 and the arm 53. Namely, the bracket 50 is connected to the arm 53 via the axis 50*b*. The axis 53*a* rotatably supports the arm 53 and the swinging lever 54. Namely, the arm 53 is connected to the swinging lever 54 via the axis 53*a*. The swinging lever 54 is fixed to the pulley 55. The pulley 55 is connected to a pulley (not shown) of the swinging motor 57 via the belt 56.

When the swinging motor 57 rotates in a rotating direction S, the driven feeding roller 24*a* moves from a contact position illustrated in a solid line at which the driven feeding roller 24*a* contacts the driving feeding roller 24*b* to a standby position illustrated in a broken line at which the driven feeding roller 24*a* separates from the driving feeding roller 24*b*. When the swinging motor 57 rotates in a rotating direction T, the driven feeding roller 24*a* moves from the standby position to the contact position. The home position shade 50*c* is provided on the bracket 50. When the driven feeding roller 24*a* is at the standby position illustrated in the broken line, the home position sensor 52 detects the home position shade 50*c*.

As illustrated in FIG. 11, the horizontal punch unit 10 is disposed downstream from the downstream jogger fence 22*b* in the sheet conveyance direction. The vertical punch unit 11 is disposed in a direction perpendicular to the sheet conveyance direction.

Figure 22:
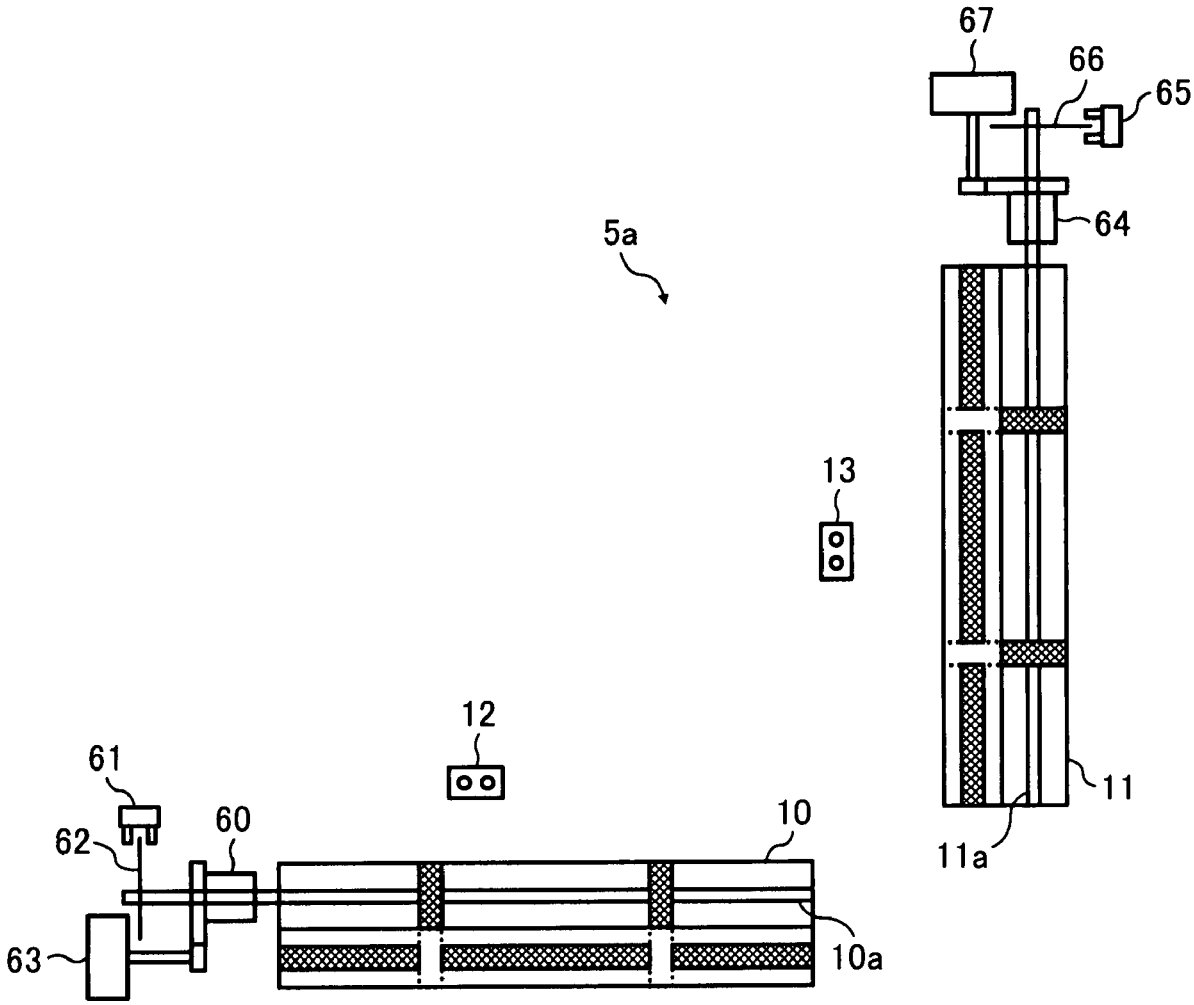
FIG. 22 is a plane view (according to another example embodiment of the present invention) of a horizontal punch unit and a vertical punch unit of the switcher shown in FIG. 11.

FIG. 22 illustrates the horizontal punch unit 10 and the vertical punch unit 11. As illustrated in FIG. 22, the horizontal punch unit 10 includes a horizontal punch driving shaft 10*a*, a horizontal punch crutch 60, a horizontal punch home position shade 62, a horizontal punch motor 63, and/or a horizontal punch home position sensor 61. The vertical punch unit 11 includes a vertical punch driving shaft 11*a*, a vertical punch crutch 64, a vertical punch home position shade 66, a vertical punch motor 67, and/or a vertical punch home position sensor 65.

The horizontal punch driving shaft 10*a* moves a punch (not shown) upward and downward to cause the punch to punch a hole in a sheet P. The horizontal punch driving shaft 10*a* and the horizontal punch crutch 60 are provided on a common shaft (not shown). The horizontal punch home position shade 62 is fixed to the common shaft. The horizontal punch crutch 60 is connected to the horizontal punch motor 63. The horizontal punch home position shade 62 shades the horizontal punch home position sensor 61 at a standby position to turn on the horizontal punch home position sensor 61.

When the horizontal punch motor 63 starts rotating, the horizontal punch crutch 60 is turned on. The horizontal punch driving shaft 10*a* rotates to move the punch upward and downward so that the punch punches a hole in a sheet P. When the horizontal punch driving shaft 10*a* rotates for one cycle, the horizontal punch home position shade 62 shades the horizontal punch home position sensor 61 again to turn on the horizontal punch home position sensor 61. The horizontal punch crutch 60 is turned off and stops at a standby position. The horizontal punch head sensor 12 is disposed before the horizontal punch unit 10 in the sheet conveyance direction in which the feeder 23 (depicted in FIG. 11) feeds a sheet P to detect a time when the sheet P stops in the horizontal punch unit 10.

The vertical punch driving shaft 11*a* moves a punch (not shown) upward and downward to cause the punch to punch a hole in a sheet P. The vertical punch driving shaft 11*a* and the vertical punch crutch 64 are provided on a common shaft (not shown). The vertical punch home position shade 66 is fixed to the common shaft. The vertical punch crutch 64 is connected to the vertical punch motor 67. The vertical punch home position shade 66 shades the vertical punch home position sensor 65 at a standby position to turn on the vertical punch home position sensor 65.

When the vertical punch motor 67 starts rotating, the vertical punch crutch 64 is turned on. The vertical punch driving shaft 11*a* rotates to move the punch upward and downward so that the punch punches a hole in a sheet P. When the vertical punch driving shaft 11*a* rotates for one cycle, the vertical punch home position shade 66 shades the vertical punch home position sensor 65 again to turn on the vertical punch home position sensor 65. The vertical punch crutch 64 is turned off and stops at a standby position. The vertical punch head sensor 13 is disposed before the vertical punch unit 11 in the sheet conveyance direction in which the feeding roller 24 (depicted in FIG. 11) feeds a sheet P to detect a time when the sheet P stops in the vertical punch unit 11.

Figure 23:
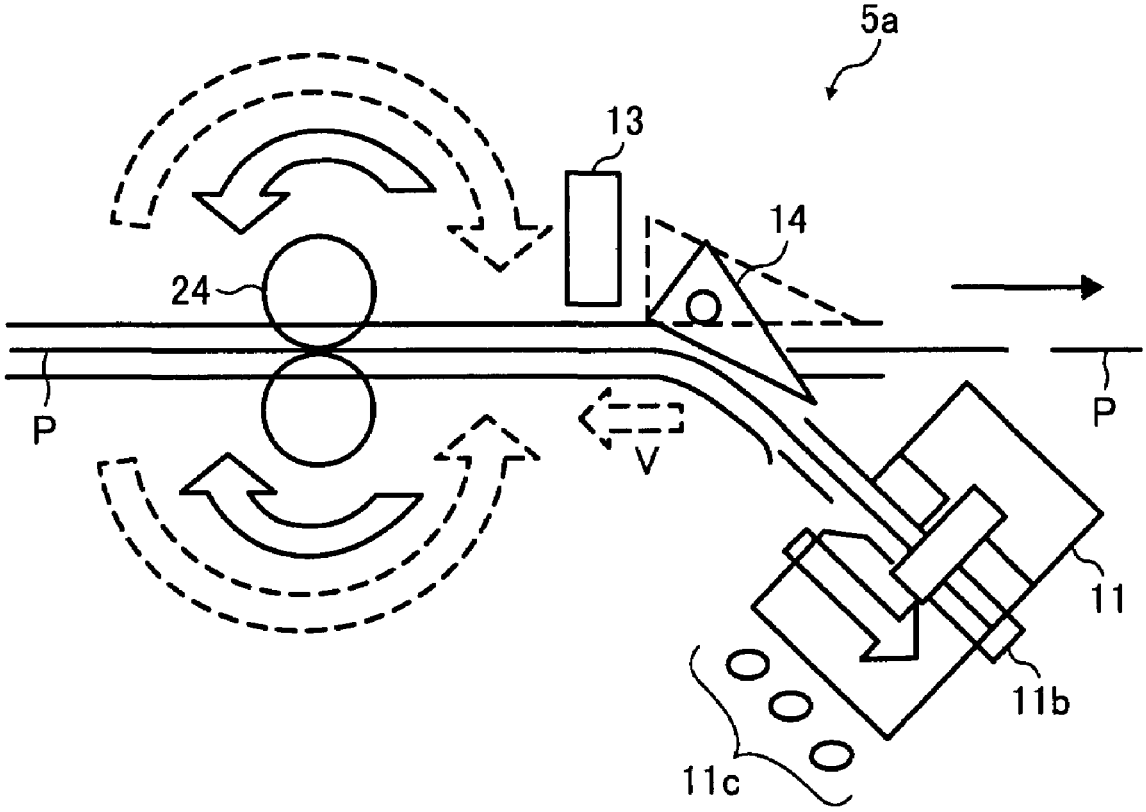
FIG. 23 is a sectional view (according to another example embodiment of the present invention) of the vertical punch unit shown in FIG. 22.

FIG. 23 is a sectional view of the vertical punch unit 11. As illustrated in FIG. 23, the switcher 5*a* further includes a switching nail 14. The vertical punch unit 11 further includes a wall 11*b* and/or a waste container 11*c*. The switching nail 14 moves between a position illustrated in a broken line and a position illustrated in a solid line to guide a sheet P. When the switching nail 14 is at the position illustrated in the solid line, the switching nail 14 guides the sheet P toward the vertical punch unit 11. When the switching nail 14 is at the position illustrated in the broken line, the switching nail 14 guides the sheet P toward the cross folder 6 (depicted in FIG. 2). When the sheet P guided by the switching nail 14 contacts the wall 11*b*, the vertical punch unit 11 punches a hole in the sheet P. The vertical punch unit 11 is slanted so that the waste container 11*c* receives punch cuttings falling from the punch after the punch punches a hole in the sheet P.

Figure 24:
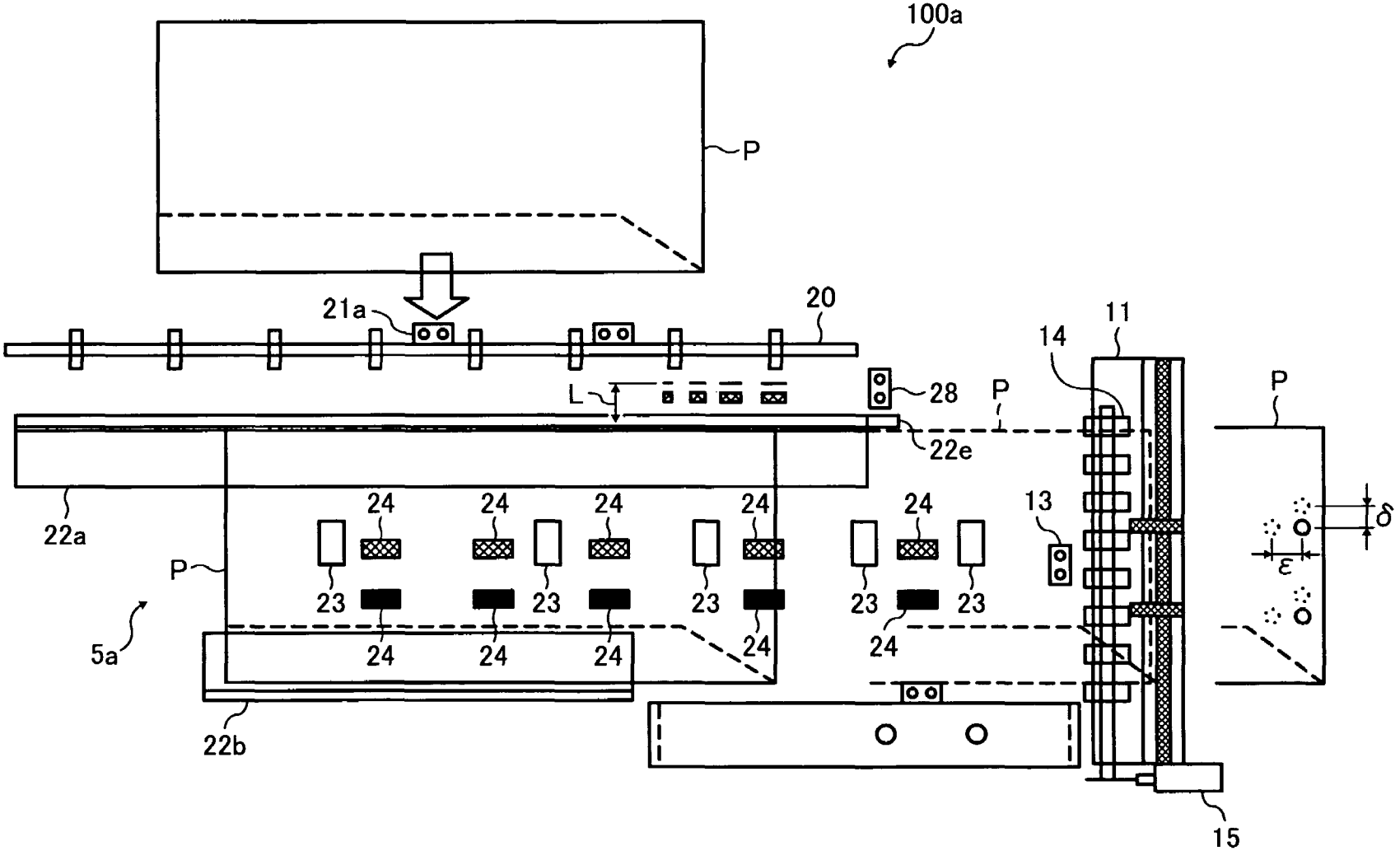
FIG. 24 is a plane view (according to another example embodiment of the present invention) of the switcher shown in FIG. 11 adjusting a punch position.

FIG. 24 is a plane view of the switcher 5*a*. As illustrated in FIG. 24, the switcher 5*a* further includes a solenoid 15 for moving the switching nail 14. When holes are punched in a sheet P in the vertical direction, the sheet P is shifted for a correction length 6 in the vertical direction and for an adjustment ϵ in the horizontal direction.

Figure 25:
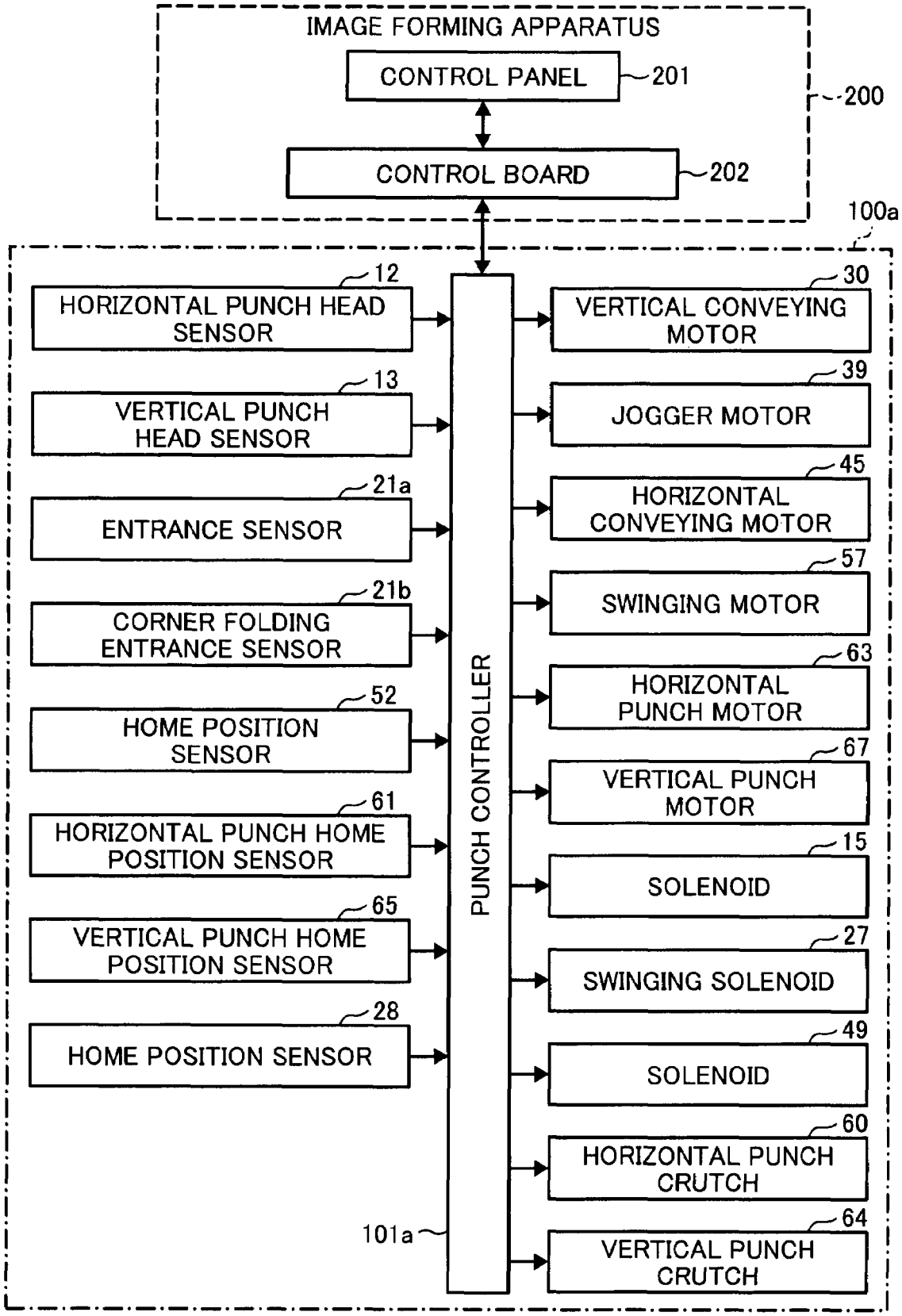
FIG. 25 is a block diagram (according to another example embodiment of the present invention) of an electric control system of the sheet processing apparatus shown in FIG. 11.

FIG. 25 is a block diagram of an electric control system of the image forming apparatus 200 and the sheet processing apparatus 100*a*. As illustrated in FIG. 25, the image forming apparatus 200 further includes a control panel 201 and/or a control board 202. The sheet processing apparatus 100*a* further includes a punch controller 101*a*. Using the image forming apparatus 200, a user operates the control panel 201 to select a folding type, a sheet size, and/or the like. The control panel 201 generates a signal according to the selected folding type, sheet size, and/or the like and sends the signal to the control board 202. The control board 202 sends information created in accordance with the signal to the sheet processing apparatus 100*a*. In the sheet processing apparatus 100*a*, the punch controller 101*a* receives the information sent from the image forming apparatus 200. The punch controller 101*a* is connected to the horizontal punch head sensor 12, the vertical punch head sensor 13, the entrance sensor 21*a*, the corner folding entrance sensor 21*b*, the home position sensor 52, the horizontal punch home position sensor 61, the vertical punch home position sensor 65, the home position sensor 28, the vertical conveying motor 30, the jogger motor 39, the horizontal conveying motor 45, the swinging motor 57, the horizontal punch motor 63, the vertical punch motor 67, the solenoid 15, the swinging solenoid 27, the solenoid 49, the horizontal punch crutch 60, the vertical punch crutch 64, and/or the like. The punch controller 101*a* controls the above-described motors, solenoids, and/or crutches based on information sent from the above-described sensors in accordance with the information sent from the image forming apparatus 200. Thus, a sheet P is properly conveyed and punched. In the punch controller 101*a*, a CPU (central processing unit (not shown)) performs a control operation in accordance with a program stored in a RAM (random access memory (not shown)) by using a ROM (read-only memory (not shown)) as a work area.

Figure 26A:
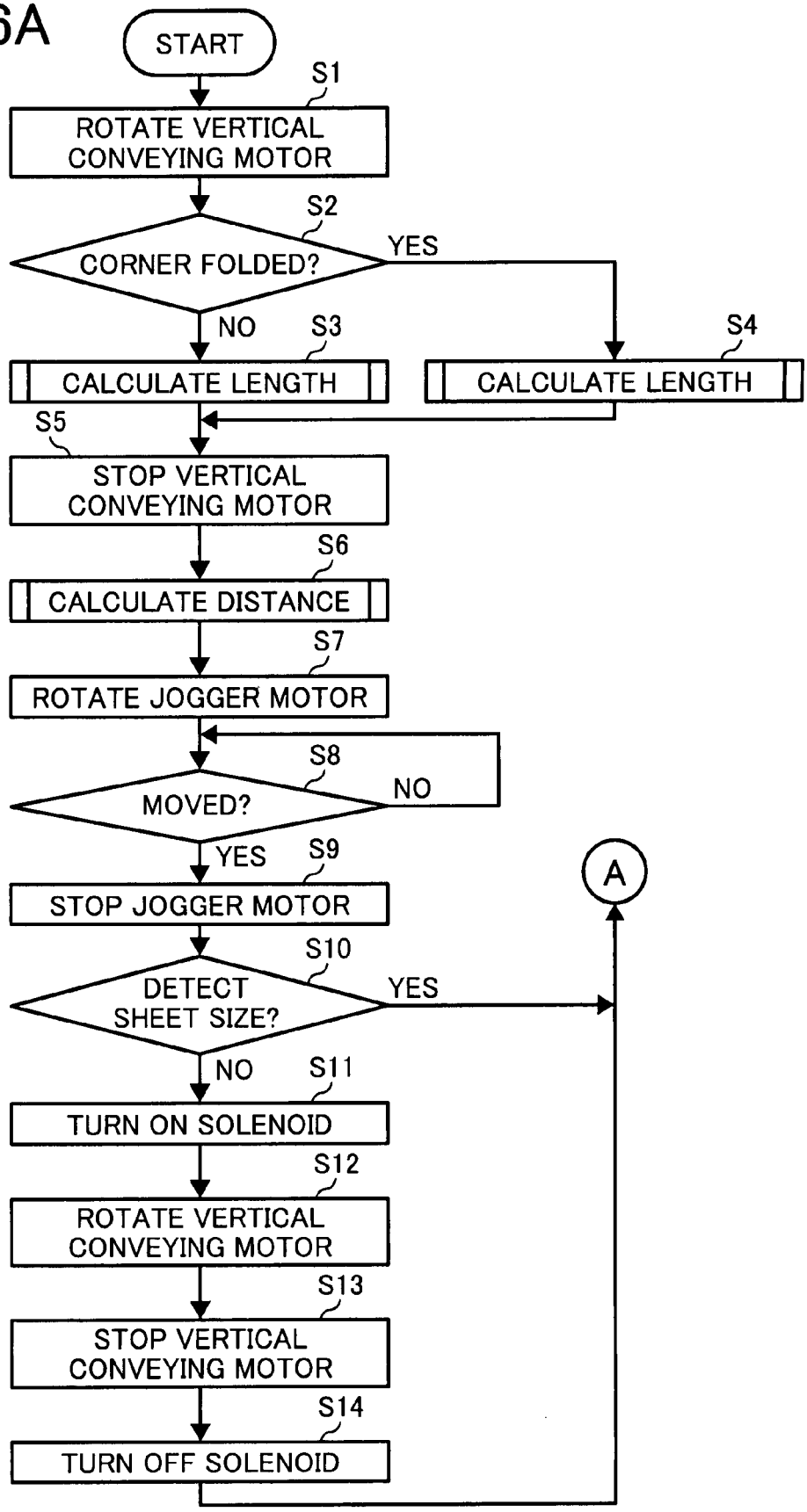
FIG. 26A is a flowchart (according to another example embodiment of the present invention) of control procedures performed by a punch controller of the electric control system shown in FIG. 25.
Figure 26B:
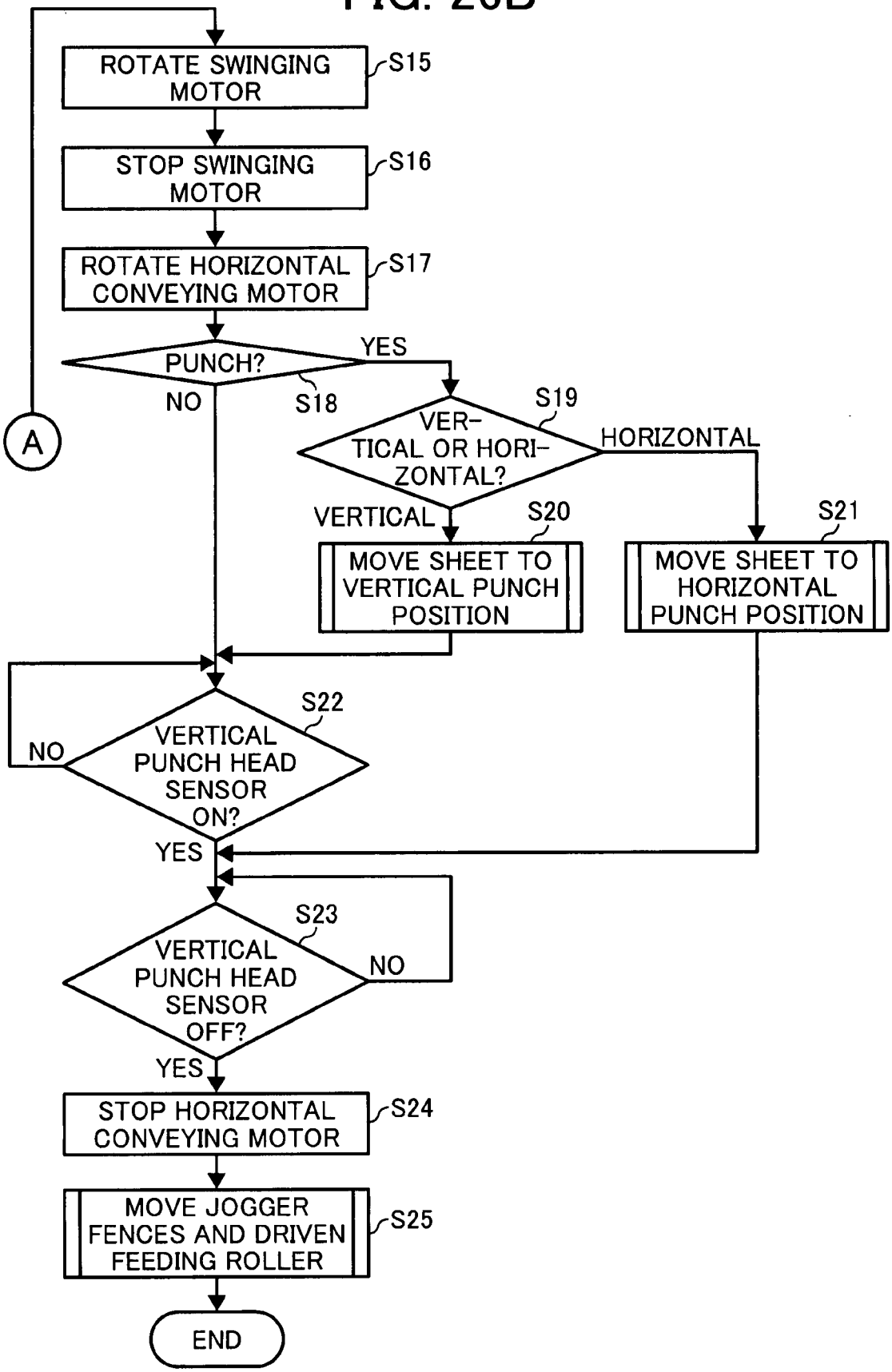
FIG. 26B is a flowchart (according to another example embodiment of the present invention) of control procedures performed by a punch controller of the electric control system shown in FIG. 25.

FIGS. 26A, 26B, 27, 28, 32, 33, 34, 35A, 35B, 35C, and 37 illustrate a flowchart of control procedures performed by the punch controller 101*a* (depicted in FIG. 25). Referring to FIGS. 26A and 26B, the following describes operations for aligning a skewed sheet P after the corner folder 3 (depicted in FIG. 1) folds a corner of a sheet P and the accordion folder 4 (depicted in FIG. 1) accordion-folds the sheet P in the sheet conveyance direction.

In step S1, the punch controller 101*a* (depicted in FIG. 25) rotates the vertical conveying motor 30 (depicted in FIG. 13) in the rotating direction CCW to rotate the entrance roller 20 (depicted in FIG. 13). In step S2, the corner folding entrance sensor 21*b* (depicted in FIG. 11) detects whether or not a corner of a sheet P sent from the accordion folder 4 (depicted in FIG. 1) is folded. When the corner of the sheet P is not folded (i.e., if NO is selected in step S2), the entrance sensor 21*a* (depicted in FIG. 11) detects α length a of the sheet P in the sheet conveyance direction in step S3. When the corner of the sheet P is folded (i.e., if YES is selected in step S2), the corner folding entrance sensor 21*b* detects the length a of the sheet P in the sheet conveyance direction in step S4.

Figure 27:
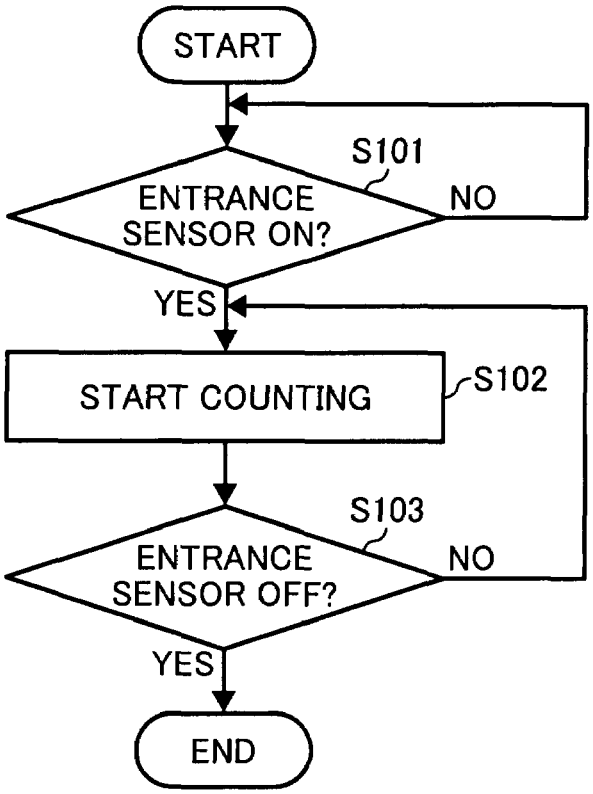
FIG. 27 is a flowchart (according to another example embodiment of the present invention) of a procedure for measuring a sheet length included in the control procedures shown in FIG. 26A.

Referring to FIG. 27, the following describes procedures of step S3 or S4 shown in FIG. 26A. In step S101, the punch controller 101*a* (depicted in FIG. 25) detects whether or not the entrance sensor 21*a* (depicted in FIG. 11) is turned on (i.e., whether or not the entrance sensor 21*a* detects the head of a sheet P in the sheet conveyance direction sent from the accordion folder 4 depicted in FIG. 1), if NO is selected in step S2 in FIG. 26A. The punch controller 101*a* detects whether or not the corner folding entrance sensor 21*b* (depicted in FIG. 11) is turned on (i.e., whether or not the corner folding entrance sensor 21*b* detects the head of a sheet P in the sheet conveyance direction sent from the accordion folder 4), if YES is selected in step S2 in FIG. 26A. When the entrance sensor 21*a* or the corner folding entrance sensor 21*b* is turned on (i.e., if YES is selected in step S101), the punch controller 101*a* starts counting to detect the length α of the sheet P in the sheet conveyance direction in step S102. In step S103, the punch controller 101*a* detects whether or not the entrance sensor 21*a* or the corner folding entrance sensor 21*b* is turned off. When the entrance sensor 21*a* or the corner folding entrance sensor 21*b* is turned off (i.e., if YES is selected in step S103), the punch controller 101*a* stops counting and calculates the length α of the sheet P in the sheet conveyance direction.

As illustrated in FIG. 26A, the punch controller 101*a* (depicted in FIG. 25) stops rotating the vertical conveying motor 30 (depicted in FIG. 13) when a reference time period elapses after the entrance roller 20 (depicted in FIG. 11) feeds the sheet P onto the upstream jogger fence 22*a* and the downstream jogger fence 22*b* (depicted in FIG. 11), in step S5. In step S6, the punch controller 101*a* calculates a distance β or β'(depicted in FIG. 12) for which the upstream jogger fence 22*a* and the downstream jogger fence 22*b* move.

Figure 28:
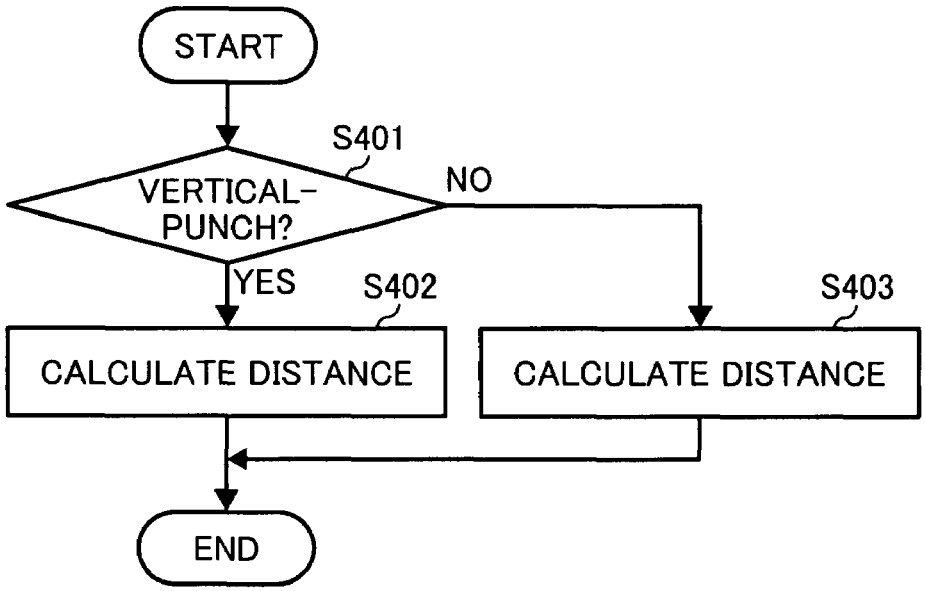
FIG. 28 is a flowchart (according to another example embodiment of the present invention) of a procedure for calculating a distance for which an upstream jogger fence and a downstream jogger fence of the switcher shown in FIG. 11 move included in the control procedures shown in FIG. 26A.

Referring to FIG. 28, the following describes procedures of step S6 shown in FIG. 26A. In step S401, the punch controller 101*a* (depicted in FIG. 25) determines whether or not the punch controller 101*a* receives an instruction to punch holes in a sheet P in the vertical direction from the image forming apparatus 200 (depicted in FIG. 25). When the punch controller 101*a* receives the instruction (i.e., if YES is selected in step S401), the punch controller 101*a* calculates the distance β (depicted in FIG. 12) in step S402. The distance β is equivalent to a distance for which the upstream jogger fence 22*a* and the downstream jogger fence 22*b* (depicted in FIG. 11) move from the standby position at which the home position shade 22*e* (depicted in FIG. 11) shades the home position sensor 28 (depicted in FIG. 11) to a position at which a space γ (depicted in FIG. 12) is provided between tail and foremost edges of the sheet P discharged onto the upstream jogger fence 22*a* and the downstream jogger fence 22*b* and the walls 22*aw* and 22*bw* of the upstream jogger fence 22*a* and the downstream jogger fence 22*b*, respectively, in the sheet conveyance direction.

As illustrated in FIG. 28, when the punch controller 101*a* (depicted in FIG. 25) does not receive the instruction (i.e., if NO is selected in step S401), the punch controller 101*a* calculates the distance β' (depicted in FIG. 12) in step S403. The distance β' is equivalent to a distance obtained by adding the correction length δ (depicted in FIG. 24) to the distance 13 (depicted in FIG. 12). According to this non-limiting example embodiment, the angle and position of the guide 29 (depicted in FIG. 12) and the rotating speed of the entrance roller 20 (depicted in FIG. 12) for feeding a sheet P onto the upstream jogger fence 22*a* and the downstream jogger fence 22*b* (depicted in FIG. 12) are adjusted to properly discharge a sheet P onto the upstream jogger fence 22*a* so that the sheet P falls at a position near the wall 22*aw* (depicted in FIG. 12) of the upstream jogger fence 22*a* facing the tail edge of the sheet P in the sheet conveyance direction. Namely, the space γ (depicted in FIG. 12) is 0 mm or close to 0 mm.

As illustrated in FIG. 26A, in step S7, the punch controller 101*a* (depicted in FIG. 25) rotates the jogger motor 39 (depicted in FIG. 13) in the rotating direction CW. In step S8, the punch controller 101*a* determines whether or not the rotating jogger motor 39 moves the upstream jogger fence 22*a* and the downstream jogger fence 22*b* (depicted in FIG. 13) for the distance β (depicted in FIG. 12) calculated in step S6. When the upstream jogger fence 22*a* and the downstream jogger fence 22*b* have moved for the distance β (i.e., if YES is selected in step S8), the punch controller 101*a* stops rotating the jogger motor 39 when the space γ (depicted in FIG. 12) is provided between the foremost and tail edges of the sheet P and the walls 22*aw* and 22*bw* of the upstream jogger fence 22*a* and the downstream jogger fence 22*b*, respectively, in the sheet conveyance direction, in step S9.

In step S10, the punch controller 101*a* judges the size of the sheet P (e.g., A4 portrait, A4 landscape, or A3 portrait). According to this non-limiting example embodiment, a sheet P having a size of A4 portrait, A4 landscape, or A3 portrait is not folded in the cross folder 6 (depicted in FIG. 2). Therefore, steps S11 to S14 are omitted for the sheet P having the size of A4 portrait, A4 landscape, or A3 portrait. A sheet P having a size other than A4 portrait, A4 landscape, and A3 portrait is folded in the cross folder 6. Therefore, steps S11 to S14 are applied to the sheet P having the size other than A4 portrait, A4 landscape, and A3 portrait.

When the punch controller 101*a* judges that the size of the sheet P is other than A4 portrait, A4 landscape, or A3 portrait (i.e., if NO is selected in step S10), the solenoid 49 (depicted in FIG. 4) is turned on and pulls the coupling 47 (depicted in FIG. 4). The vertical conveying arm 26 (depicted in FIG. 4) rotates around the axis 26*a* (depicted in FIG. 4) from the position illustrated in the broken line to the position illustrated in the solid line. The driven feed-back roller 23*a* (depicted in FIG. 4) attached to the vertical conveying arm 26 via the pressing spring 46 (depicted in FIG. 4) pressingly contacts the driving feed-back roller 23*b* (depicted in FIG. 4), in step S11. Accordingly, the guide 25 (depicted in FIG. 19) rotatably supported by the axis 23*c* (depicted in FIG. 19) which also supports the driven feed-back roller 23*a* (depicted in FIG. 19) presses the top surface of the sheet P. When a reference time period elapses, the punch controller 101*a* rotates the vertical conveying motor 30 (depicted in FIG. 13) in a direction counter to the rotating direction CCW. The driving feed-back roller 23*b* (depicted in FIG. 19) feeds the sheet P toward the wall 22*aw* of the upstream jogger fence 22*a* (depicted in FIG. 19), in step S12.

In step S13, the punch controller 101*a* stops rotating the vertical conveying motor 30 when a reference time period elapses after the sheet P contacts the wall 22*aw* of the upstream jogger fence 22*a* (i.e., after the sheet P moves from a position illustrated in a solid line to a position illustrated in a broken line in FIG. 19). In step S14, the punch controller 101*a* turns off the solenoid 49 (depicted in FIG. 4). Accordingly, the driven feed-back roller 23*a* separates from the driving feed-back roller 23*b*. Namely, the driven feed-back roller 23*a* moves from the position illustrated in the solid line to the position (i.e., the standby position) illustrated in the broken line in FIG. 4.

When the punch controller 101*a* judges that the size of the sheet P is either A4 portrait, A4 landscape, or A3 portrait (i.e., if YES is selected in step S10) or when the punch controller 101*a* turns off the solenoid 49 in step S14, the punch controller 101*a* rotates the swinging motor 57 (depicted in FIG. 21) in the rotating direction T. Accordingly, the driven feeding roller 24*a* moves from the position (i.e., the standby position) illustrated in the broken line to the position illustrated in the solid line in FIG. 21 to contact the driving feeding roller 24*b*, in step S15 in FIG. 26B.

Figure 29:
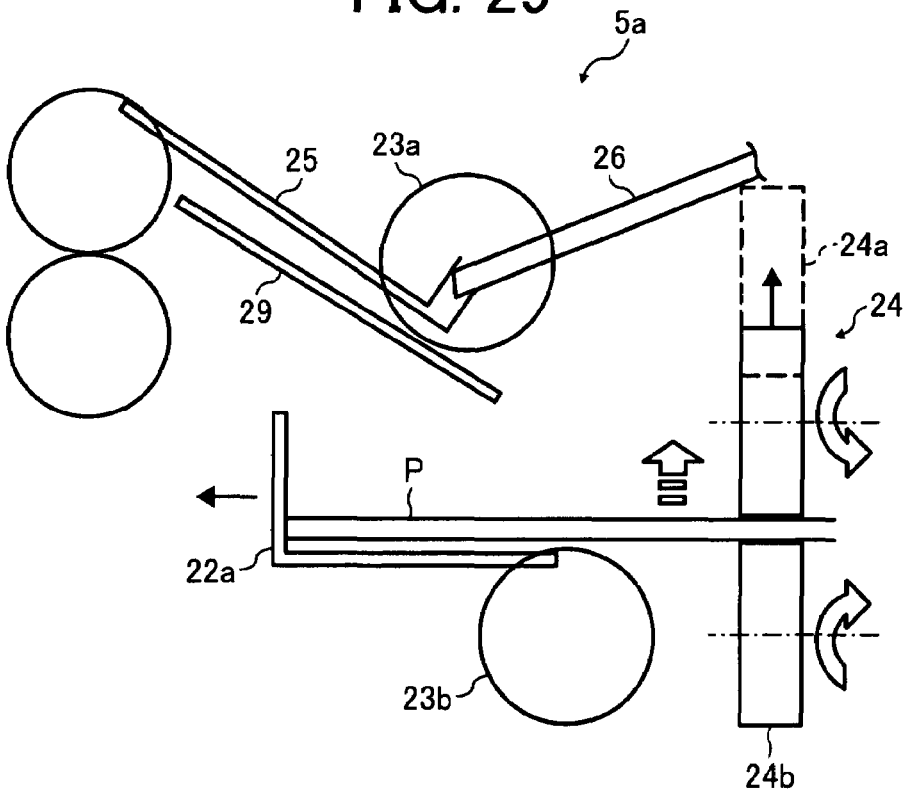
FIG. 29 is a sectional view (according to another example embodiment of the present invention) of the switcher shown in FIG. 11 when a driven feeding roller and a driving feeding roller of the switcher shown in FIG. 11 nip a sheet.
Figure 30:
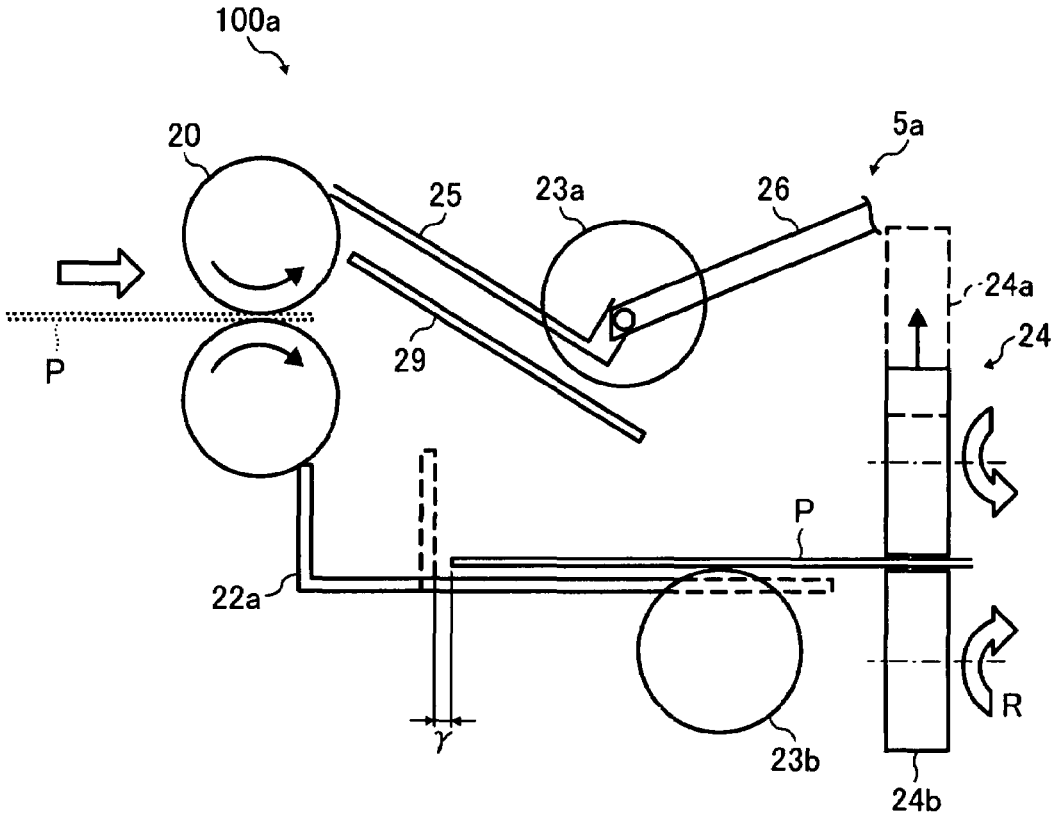
FIG. 30 is a sectional view (according to another example embodiment of the present invention) of the switcher shown in FIG. 11 when the driven feeding roller and the driving feeding roller shown in FIG. 29 feed a sheet.

As illustrated in FIG. 26B, in step S16, when a reference time period elapses after the punch controller 101*a* rotates the swinging motor 57 in step S15, the punch controller 101*a* stops rotating the swinging motor 57 while the driven feeding roller 24*a* and the driving feeding roller 24*b* nip the sheet P as illustrated in FIG. 29. In step S17, the punch controller 101*a* rotates the horizontal conveying motor 45 (depicted in FIG. 20) in the rotating direction Q. Accordingly, the driving feeding roller 24*b* (depicted in FIG. 20) rotates in the rotating direction R. As illustrated in FIG. 30, the driven feeding roller 24*a* presses the sheet P toward the driving feeding roller 24*b* so that the driven feeding roller 24*a* and the driving feeding roller 24*b* nip the sheet P. The driving feeding roller 24*b* rotating in the rotating direction R (depicted in FIG. 20) feeds the sheet P in a direction U (i.e., the horizontal direction) in the switcher 5*a* (depicted in FIG. 17). As illustrated in FIG. 24, the shaded feeding rollers 24 are disposed near the feeders 23. The solid feeding rollers 24 are disposed far from the feeders 23. The shaded feeding rollers 24 have a greater conveying force than the solid feeding rollers 24. As illustrated in FIG. 29, when the feeding rollers 24 feed a sheet P, the driven feed-back roller 23*b* contacting an under surface of the sheet P applies a load to the shaded feeding rollers 24 (depicted in FIG. 24) via the sheet P. To address this problem, the shaded feeding rollers 24 have the greater conveying force so that the conveying forces of the shaded feeding rollers 24 and the solid feeding rollers 24 are balanced.

Figure 31:
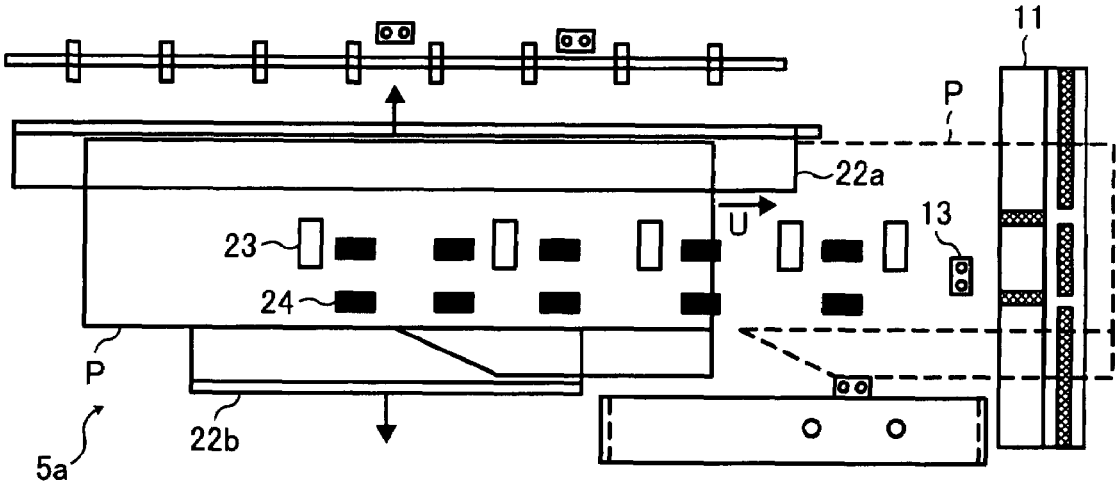
FIG. 31 is a plane view (according to another example embodiment of the present invention) of the switcher shown in FIG. 11 when the driven feeding roller and the driving feeding roller shown in FIG. 29 feed a sheet.
Figure 32:
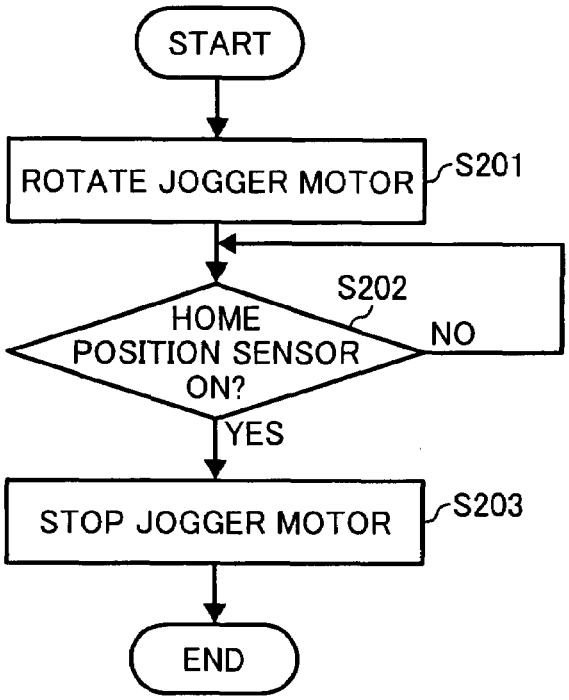
FIG. 32 is a flowchart (according to another example embodiment of the present invention) of a procedure for moving the upstream jogger fence and the downstream jogger fence shown in FIG. 28 to standby positions included in the control procedures shown in FIG. 26B.

As illustrated in FIG. 26B, the punch controller 101*a* (depicted in FIG. 25) determines whether or not the punch controller 101*a* receives an instruction to punch holes in the sheet P from the image forming apparatus 200 (depicted in FIG. 25), in step S18. When the punch controller 101*a* receives the instruction (i.e., if YES is selected in step S18), the punch controller 101*a* determines whether the instruction instructs to punch holes in the vertical direction or the horizontal direction in step S19. When the instruction instructs to punch holes in the vertical direction, the punch controller 101*a* moves the sheet P to a vertical punch position for punching holes in the vertical direction in step S20. When the instruction instructs to punch holes in the horizontal direction, the punch controller 101*a* moves the sheet P to a horizontal punch position for punching holes in the horizontal direction in step S21. When the punch controller 101*a* does not receive the instruction (i.e., if NO is selected in step S18) or when the sheet P has moved to a proper position for punching holes in the vertical direction in step S20, the feeding rollers 24 feed the sheet P in the direction U toward the cross folder 6 (depicted in FIG. 2) as illustrated in FIG. 31. In step S22, the punch controller 101*a* determines whether or not the head of the sheet P passes the vertical punch head sensor 13 (i.e., whether or not the vertical punch head sensor 13 is turned on) as illustrated in a broken line in FIG. 31. When the punch controller 101 a determines that the head of the sheet P passes the vertical punch head sensor 13 (i.e., if YES is selected in step S22), the punch controller 101*a* determines whether or not the tail of the sheet P passes the vertical punch head sensor 13 (i.e., whether or not the vertical punch head sensor 13 is turned off) in step S23. When the punch controller 101*a* determines that the tail of the sheet P passes the vertical punch head sensor 13 (i.e., if YES is selected in step S23), the punch controller 101*a* stops rotating the horizontal conveying motor 45 (depicted in FIG. 20) in step S24. In step S25, the punch controller 101*a* performs operations for moving the upstream jogger fence 22*a*, the downstream jogger fence 22*b* (depicted in FIG. 31), and the driven feeding roller 24*a* (depicted in FIG. 21) to the standby positions, respectively Referring to FIG. 32, the following describes procedures of step S25 shown in FIG. 26B. Namely, FIG. 32 illustrates procedures for moving the upstream jogger fence 22*a* and the downstream jogger fence 22*b* (depicted in FIG. 11) to the standby positions, respectively, at which the home position shade 22*e* (depicted in FIG. 11) shades the home position sensor 28 (depicted in FIG. 11) to turn on the home position sensor 28.

In step S201, the punch controller 101*a* (depicted in FIG. 25) rotates the jogger motor 39 (depicted in FIG. 13) in a rotating direction counter to the rotating direction CW to move the upstream jogger fence 22*a* and the downstream jogger fence 22*b* (depicted in FIG. 13) in directions in which the upstream jogger fence 22*a* and the downstream jogger fence 22*b* move away from each other. In step S202, the punch controller 101*a* determines whether or not the home position shade 22*e* shades the home position sensor 28 to turn on the home position sensor 28. When the punch controller 101*a* determines that the home position sensor 28 is turned on (i.e., if YES is selected in step S202), the punch controller 101*a* stops rotating the jogger motor 39 in step S203. Thus, the upstream jogger fence 22*a* and the downstream jogger fence 22*b* return to the standby positions, respectively.

Figure 33:
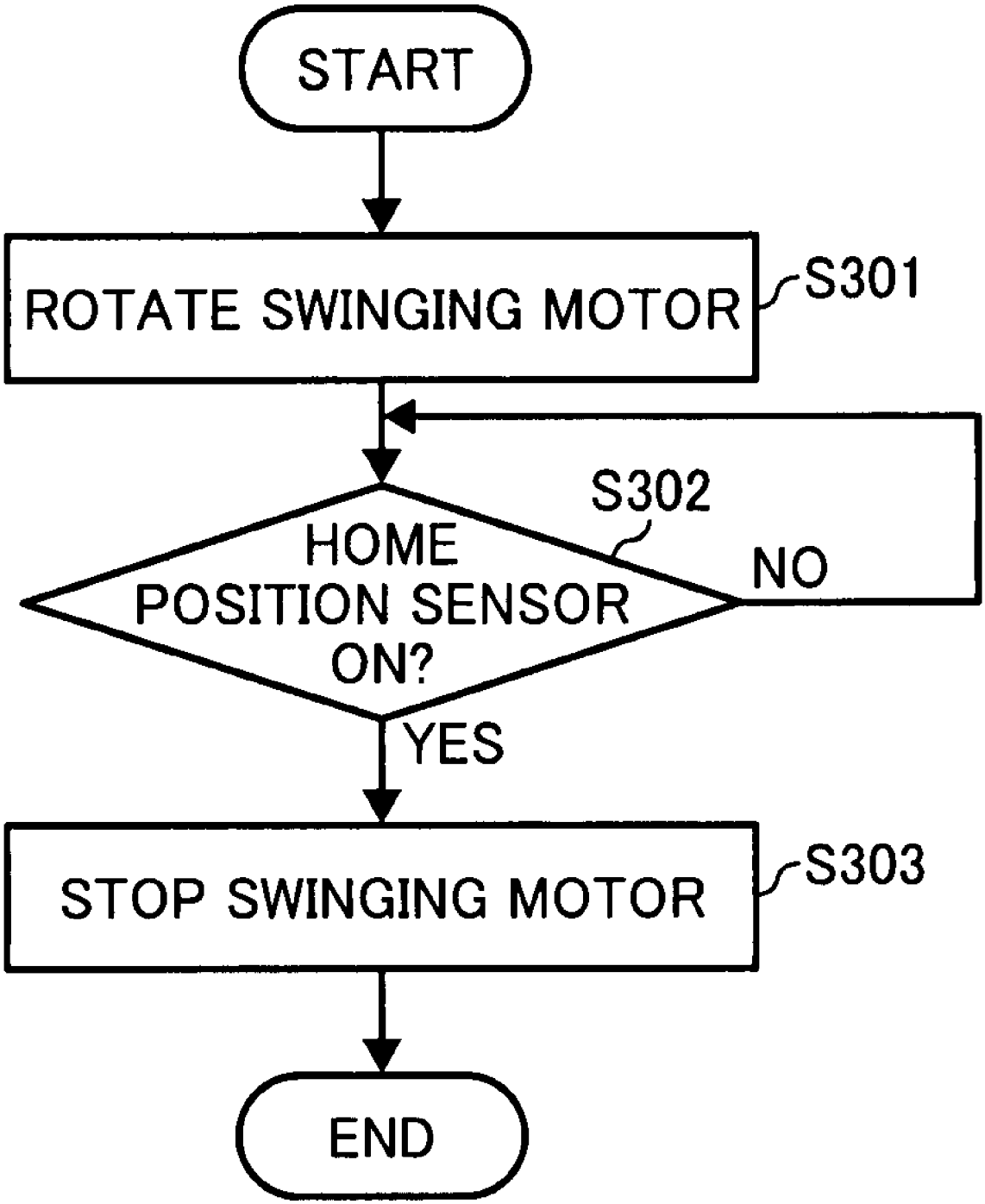
FIG. 33 is a flowchart (according to another example embodiment of the present invention) of a procedure for moving the driven feeding roller shown in FIG. 29 to a standby position included in the control procedures shown in FIG. 26B.

Referring to FIG. 33, the following describes procedures of step S25 shown in FIG. 26B. Namely, FIG. 33 illustrates procedures for moving the driven feeding roller 24*a* (depicted in FIG. 21) to the standby position.

In step S301, the punch controller 101*a* (depicted in FIG. 25) rotates the swinging motor 57 (depicted in FIG. 21) in the rotating direction S to move the driven feeding roller 24*a* from the contact position illustrated in the solid line at which the driven feeding roller 24*a* contacts the driving feeding roller 24*b* (depicted in FIG. 21) to the standby position illustrated in the broken line at which the driven feeding roller 24*a* separates from the driving feeding roller 24*b*. In step S302, the punch controller 101*a* determines whether or not the home position shade 50*c* (depicted in FIG. 21) shades the home position sensor 52 (depicted in FIG. 21) to turn on the home position sensor 52. When the punch controller 101*a* determines that the home position sensor 52 is turned on (i.e., if YES is selected in step S302), the punch controller 101*a* stops rotating the swinging motor 57 in step S303. Thus, the driven feeding roller 24*a* returns to the standby position.

Figure 34:
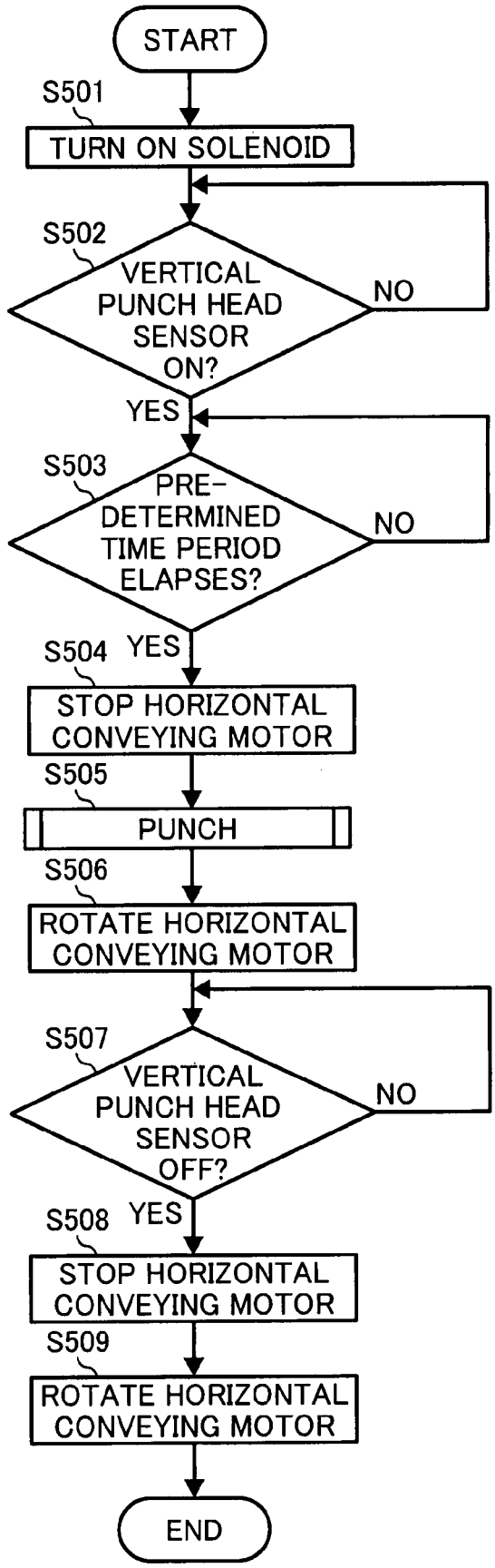
FIG. 34 is a flowchart (according to another example embodiment of the present invention) of a procedure for moving a sheet to a vertical punch position for punching holes in the sheet in a vertical direction included in the control procedures shown in FIG. 26B.

Referring to FIG. 34, the following describes procedures of step S20 shown in FIG. 26B. Namely, FIG. 34 illustrates procedures for moving a sheet P to the vertical punch position for punching holes in the sheet P in the vertical direction.

In step S501, the punch controller 101*a* (depicted in FIG. 25) turns on the solenoid 15 (depicted in FIG. 24) to move the switching nail 14 (depicted in FIG. 23) from the position illustrated in the broken line to the position illustrated in the solid line, so that the switching nail 14 guides a sheet P toward the vertical punch unit 11 (depicted in FIG. 23). When the head of the sheet P guided by the switching nail 14 passes the vertical punch head sensor 13 (depicted in FIG. 23), the vertical punch head sensor 13 is turned on. Therefore, in step S502, the punch controller 101*a* determines whether or not the vertical punch head sensor 13 is turned on. When the punch controller 101*a* determines that the vertical punch head sensor 13 is turned on (i.e., if YES is selected in step S502), the punch controller 101*a* determines whether or not a reference time period elapses in step S503. The reference time period is equivalent, e.g., to a time period calculated by adding a time period sufficient for conveying the sheet P for the correction length δ (depicted in FIG. 24) to a time period sufficient for conveying the sheet P to the vertical punch position. When the correction length δ is 0, the head of the sheet P contacts the wall 11*b* (depicted in FIG. 23). When the reference time period elapses (i.e., if YES is selected in S503), the punch controller 101*a* stops rotating the horizontal conveying motor 45 (depicted in FIG. 20) in step S504. In step S505, the vertical punch unit 11 punches holes in the sheet P in the vertical direction.

In step S506, the punch controller 101*a* rotates the horizontal conveying motor 45 in a rotating direction counter to the rotating direction Q. Accordingly, the driving feeding roller 24*b* (depicted in FIG. 20) rotates in a rotating direction counter to the rotating direction R to feed back the sheet P in a direction V (depicted in FIG. 23). When the head of the sheet P passes the vertical punch head sensor 13 (depicted in FIG. 23), the vertical punch head sensor 13 is turned off. Therefore, in step S507, the punch controller 101*a* determines whether or not the vertical punch head sensor 13 is turned off. When the vertical punch head sensor 13 is turned off (i.e., if YES is selected in step S507), the punch controller 101*a* stops rotating the horizontal conveying motor 45 and turns off the solenoid 15 (depicted in FIG. 24) to stop feeding back the sheet P, in step S508. In step S509, the punch controller 101*a* rotates the horizontal conveying motor 45 in the rotating direction Q to rotate the driving feeding roller 24*b* in the rotating direction R, as illustrated in FIG. 20. Specifically, as illustrated in FIG. 30, the driving feeding roller 24*b* nips the sheet P together with the driven feeding roller 24*a* and rotates in the rotating direction R to feed the sheet P in the direction U (depicted in FIG. 17) toward the cross folder 6 (depicted in FIG. 2).

Figure 35A:
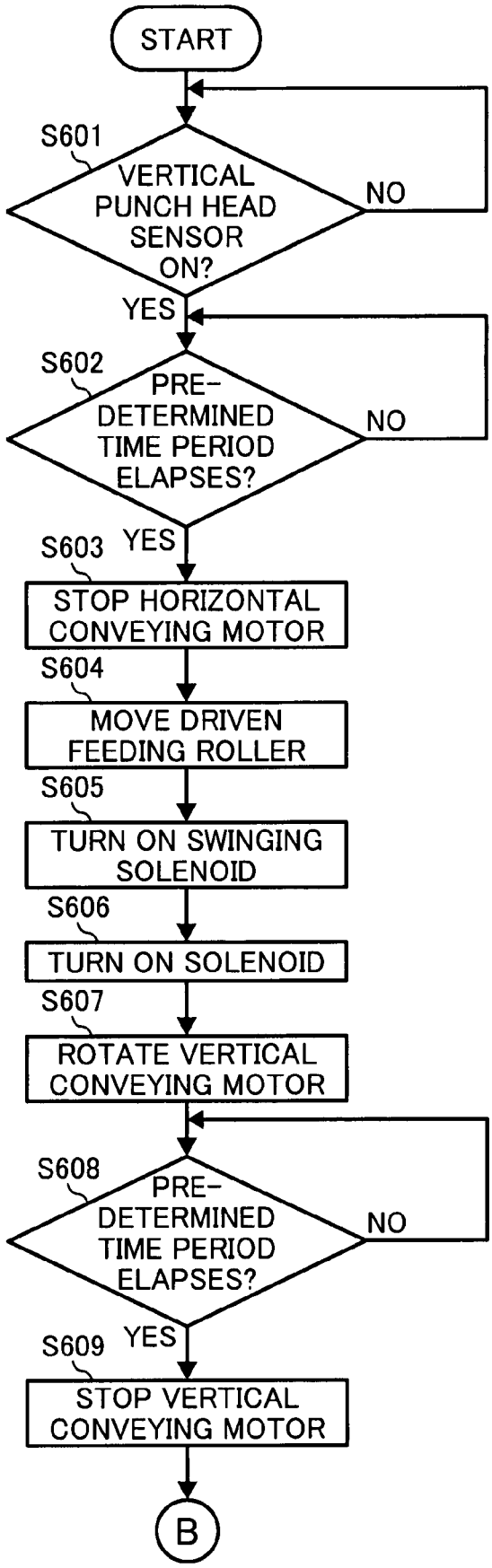
FIG. 35A is a flowchart (according to another example embodiment of the present invention) of a procedure for moving a sheet to a horizontal punch position for punching holes in the sheet in a horizontal direction included in the control procedures shown in FIG. 26B.
Figure 35B:
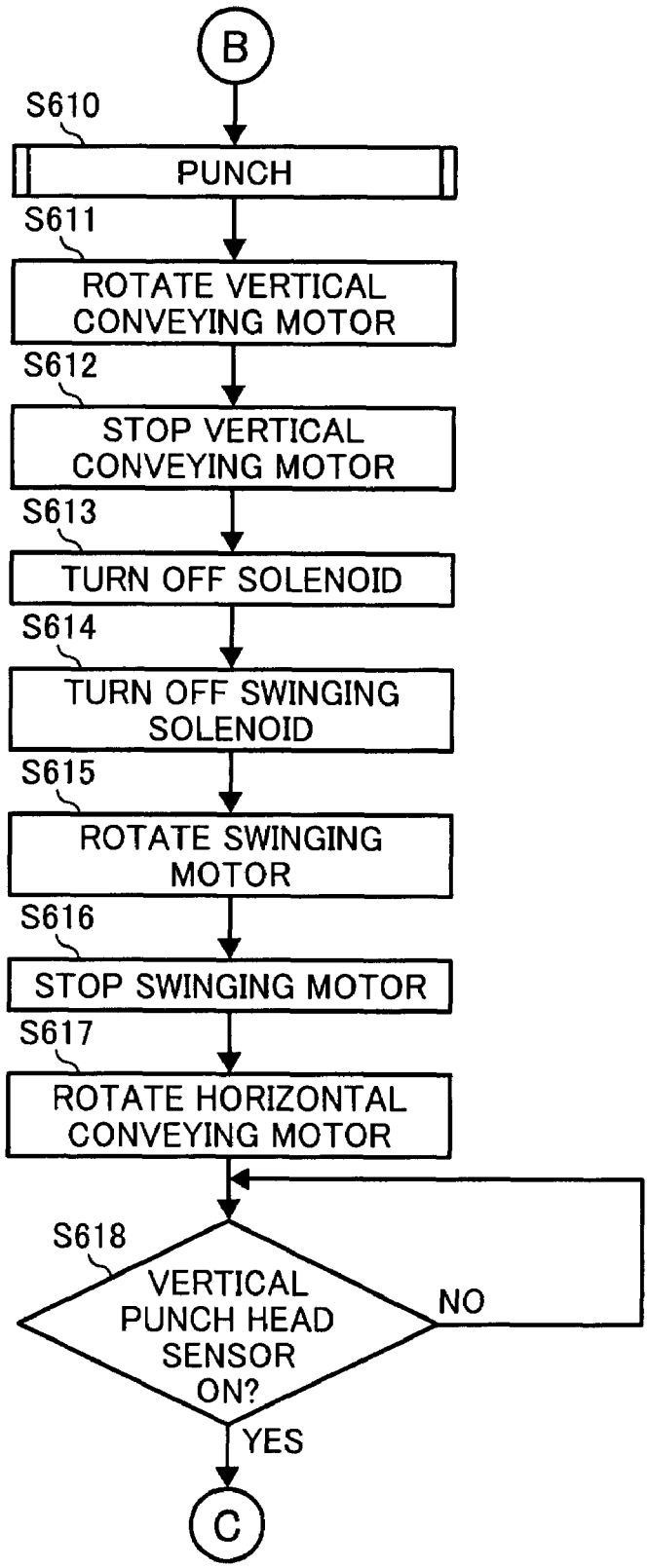
FIG. 35B is a flowchart (according to another example embodiment of the present invention) of a procedure for moving a sheet to a horizontal punch position for punching holes in the sheet in a horizontal direction included in the control procedures shown in FIG. 26B.
Figure 35C:
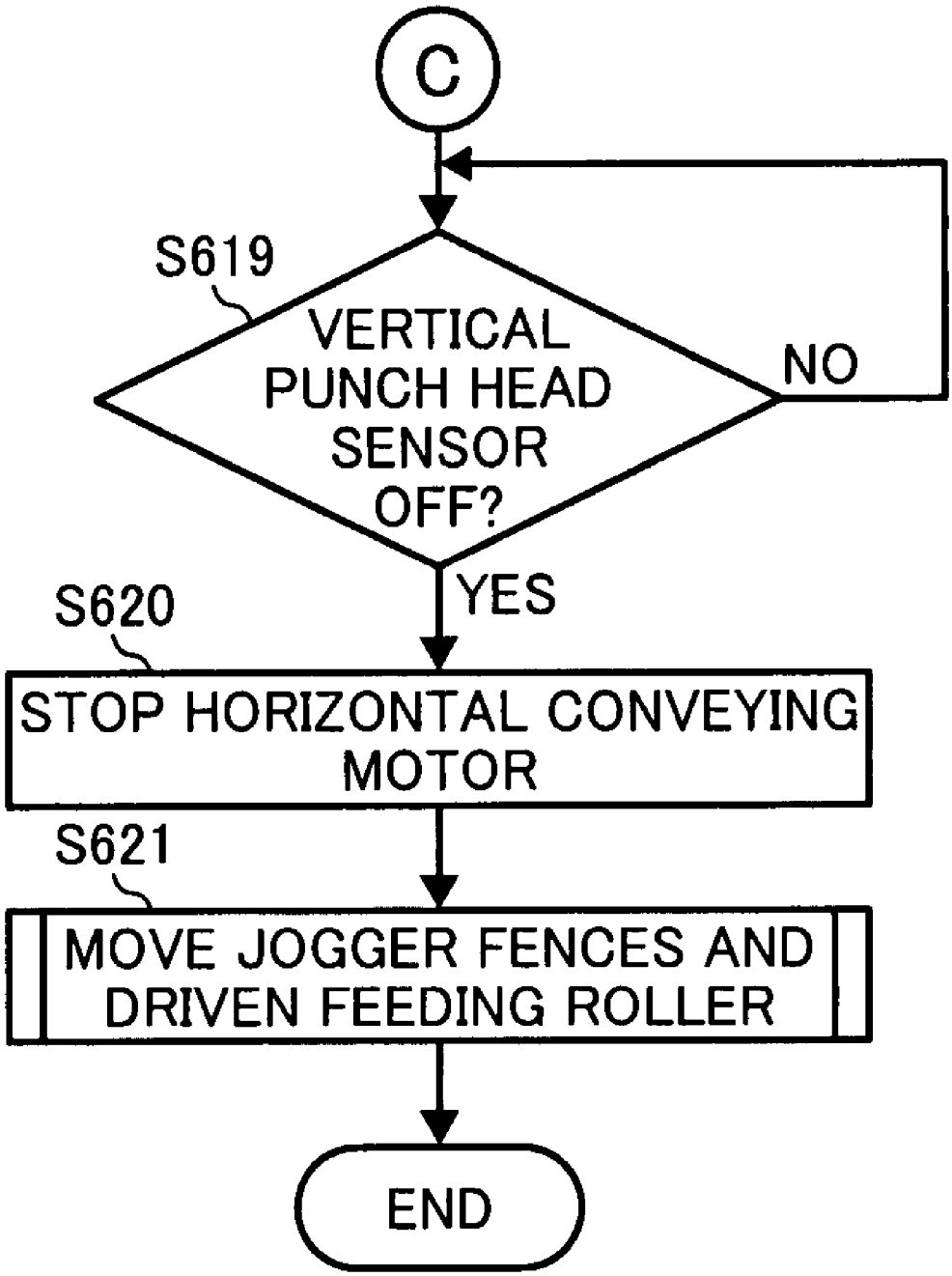
FIG. 35C is a flowchart (according to another example embodiment of the present invention) of a procedure for moving a sheet to a horizontal punch position for punching holes in the sheet in a horizontal direction included in the control procedures shown in FIG. 26B.

Referring to FIGS. 35A, 35B, and 35C, the following describes procedures of step S21 shown in FIG. 26B. Namely, FIGS. 35A, 35B, and 35C illustrate procedures for moving a sheet P to the horizontal punch position for punching holes in the sheet P in the horizontal direction.

When the head of a sheet P passes the vertical punch head sensor 13 (depicted in FIG. 24), the vertical punch head sensor 13 is turned on. Therefore, in step S601, the punch controller 101*a* (depicted in FIG. 25) determines whether or not the vertical punch head sensor 13 is turned on. When the punch controller 101*a* determines that the vertical punch head sensor 13 is turned on (i.e., if YES is selected in step S601), the punch controller 101*a* determines whether or not a reference time period elapses in step S602. The reference time period is equivalent, e.g., to a time period calculated by adding a time period sufficient for conveying the sheet P for the adjustment E (depicted in FIG. 24) to a time period sufficient for conveying the sheet P to the horizontal punch position. When the reference time period elapses (i.e., if YES is selected in S602), the punch controller 101*a* stops rotating the horizontal conveying motor 45 (depicted in FIG. 20) in step S603. In step S604, the procedures illustrated in FIG. 33 for moving the driven feeding roller 24*a* (depicted in FIG. 21) to the standby position are performed to switch the sheet conveyance direction from the horizontal direction to the vertical direction.

As illustrated in FIG. 15, in step S605, the punch controller 101*a* (depicted in FIG. 25) turns on the swinging solenoid 27 to rotate the downstream jogger fence 22*b* around the axis 22*c*, so that the downstream jogger fence 22*b* moves from the position illustrated in the broken line to the position illustrated in the solid line. As illustrated in FIG. 4, in step S606, the punch controller 101*a* (depicted in FIG. 25) turns on the solenoid 49 to move the vertical conveying arm 26 from the position illustrated in the broken line to the position illustrated in the solid line. Accordingly, the driven feed-back roller 23*a* pressingly contacts the driving feed-back roller 23*b* as illustrated in FIG. 15. In step S607, when a reference time period elapses, the punch controller 101*a* rotates the vertical conveying motor 30 (depicted in FIG. 13) in the rotating direction CCW. Accordingly, the driving feed-back roller 23*b* rotates in a rotating direction X to feed the sheet P in the direction L as illustrated in FIG. 15. When the head of the sheet P passes the horizontal punch head sensor 12 (depicted in FIG. 15), the horizontal punch head sensor 12 is turned on. When the horizontal punch head sensor 12 is turned on, the punch controller 101*a* determines whether or not a reference time period elapses in step S608. The reference time period is equivalent, e.g., to a time period calculated by adding a time period sufficient for conveying the sheet P for the adjustment $\epsilon$ (depicted in FIG. 24) to a time period sufficient for conveying the sheet P to the horizontal punch position. When the adjustment $\epsilon$ is 0, the head of the sheet P contacts the wall 10*b* (depicted in FIG. 15). When the reference time period elapses (i.e., if YES is selected in S608), the punch controller 101*a* stops rotating the vertical conveying motor 30 in step S609.

Figure 36:
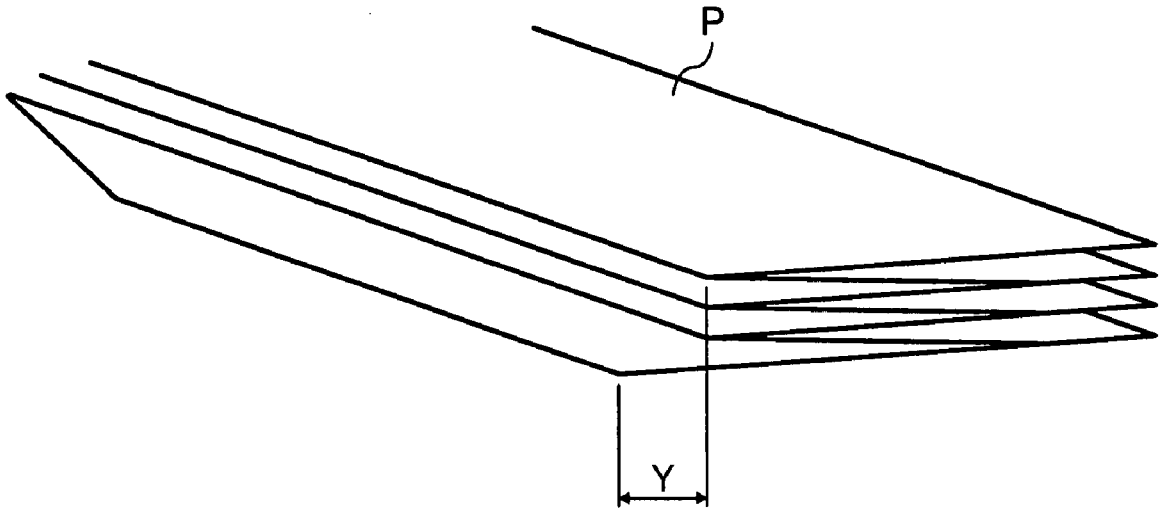
FIG. 36 is a perspective view (according to another example embodiment of the present invention) of an accordion-folded sheet of which corner is folded.

FIG. 36 is a perspective view of an accordion-folded sheet P of which corner is folded. As illustrated in FIG. 36, the sheet P includes a binding margin length Y. The binding margin length Y is a length of a binding margin of the sheet P, which is not accordion-folded. In FIG. 18, the binding margin of the sheet P is illustrated in a broken line. The horizontal punch unit 10 has a width W greater than a width of the binding margin in a longitudinal direction of the binding margin, so that the binding margin is inserted into the horizontal punch unit 10.

As illustrated in FIG. 18, the feeders 23 oppose punch positions (i.e., the horizontal punch position) at which the horizontal punch unit 10 punches holes in a sheet P. As illustrated in FIG. 35B, in step S610, the horizontal punch unit 10 (depicted in FIG. 18) punches holes in the sheet P at the horizontal punch position. In step S611, the punch controller 101*a* (depicted in FIG. 25) rotates the vertical conveying motor 30 (depicted in FIG. 13) in a rotating direction counter to the rotating direction CCW. Accordingly, as illustrated in FIG. 15, the driving feed-back roller 23*b* rotates in a rotating direction Z to feed back the sheet P in the direction M toward the wall 22*aw* of the upstream jogger fence 22*a*. In step S612 in FIG. 35B, when a reference time period elapses (i.e., after the sheet P contacts the wall 22*aw*), the punch controller 101*a* stops rotating the vertical conveying motor 30.

In step S613, the punch controller 101*a* turns off the solenoid 49 (depicted in FIG. 4). Accordingly, as illustrated in FIG. 4, the driven feed-back roller 23*a* moves from the position illustrated in the solid line to the position illustrated in the broken line. Namely, the driven feed-back roller 23*a* separates from the driving feed-back roller 23*b* to return to the standby position. In step S614 in FIG. 35B, as illustrated in FIG. 15, the punch controller 101*a* (depicted in FIG. 25) turns off the swinging solenoid 27. The downstream jogger fence 22*b* rotates around the axis 22*c* to move from the position illustrated in the solid line to the position illustrated in the broken line. In step S615 in FIG. 35B, as illustrated in FIG. 21, the punch controller 101*a* (depicted in FIG. 25) rotates the swinging motor 57 in the rotating direction T to move the driven feeding roller 24*a* from the position illustrated in the broken line to the position illustrated in the solid line. Namely, the driven feeding roller 24*a* moves from the standby position at which the driven feeding roller 24*a* separates from the driving feeding roller 24*b* to the contact position at which the driven feeding roller 24*a* contacts the driving feeding roller 24*b*. In step S616 in FIG. 35B, as illustrated in FIG. 15, when a reference time period elapses, the punch controller 101*a* (depicted in FIG. 25) stops rotating the swinging motor 57 (depicted in FIG. 21) while the driven feeding roller 24*a* moved to the position illustrated in the broken line nips the sheet P together with the driving feeding roller 24*b*.

In step S617 in FIG. 35B, as illustrated in FIG. 20, the punch controller 101*a* (depicted in FIG. 25) rotates the horizontal conveying motor 45 in the rotating direction Q. Accordingly, the driving feeding roller 24*b* rotates in the rotating direction R to feed the sheet P toward the cross folder 6 (depicted in FIG. 2). In step S618 in FIG. 35B, the punch controller 101*a* determines whether or not the vertical punch head sensor 13 (depicted in FIG. 23) is turned on (i.e., whether or not the head of the sheet P passes the vertical punch head sensor 13). When the vertical punch head sensor 13 is tuned on (i.e., if YES is selected in step S618), the punch controller 101*a* determines whether or not the vertical punch head sensor 13 is turned off (i.e., whether or not the tail of the sheet P passes the vertical punch head sensor 13) in step S619 as illustrated in FIG. 35C. When the vertical punch head sensor 13 is tuned off (i.e., if YES is selected in step S619), the punch controller 101*a* stops rotating the horizontal conveying motor 45 in step S620. In step S621, the punch controller 101*a* performs the procedures, illustrated in FIG. 32, for moving the upstream jogger fence 22*a* and the downstream jogger fence 22*b* (depicted in FIG. 31) to the standby positions, respectively, and the procedures, illustrated in FIG. 33, for moving the driven feeding roller 24*a* (depicted in FIG. 21) to the standby position.

Figure 37:
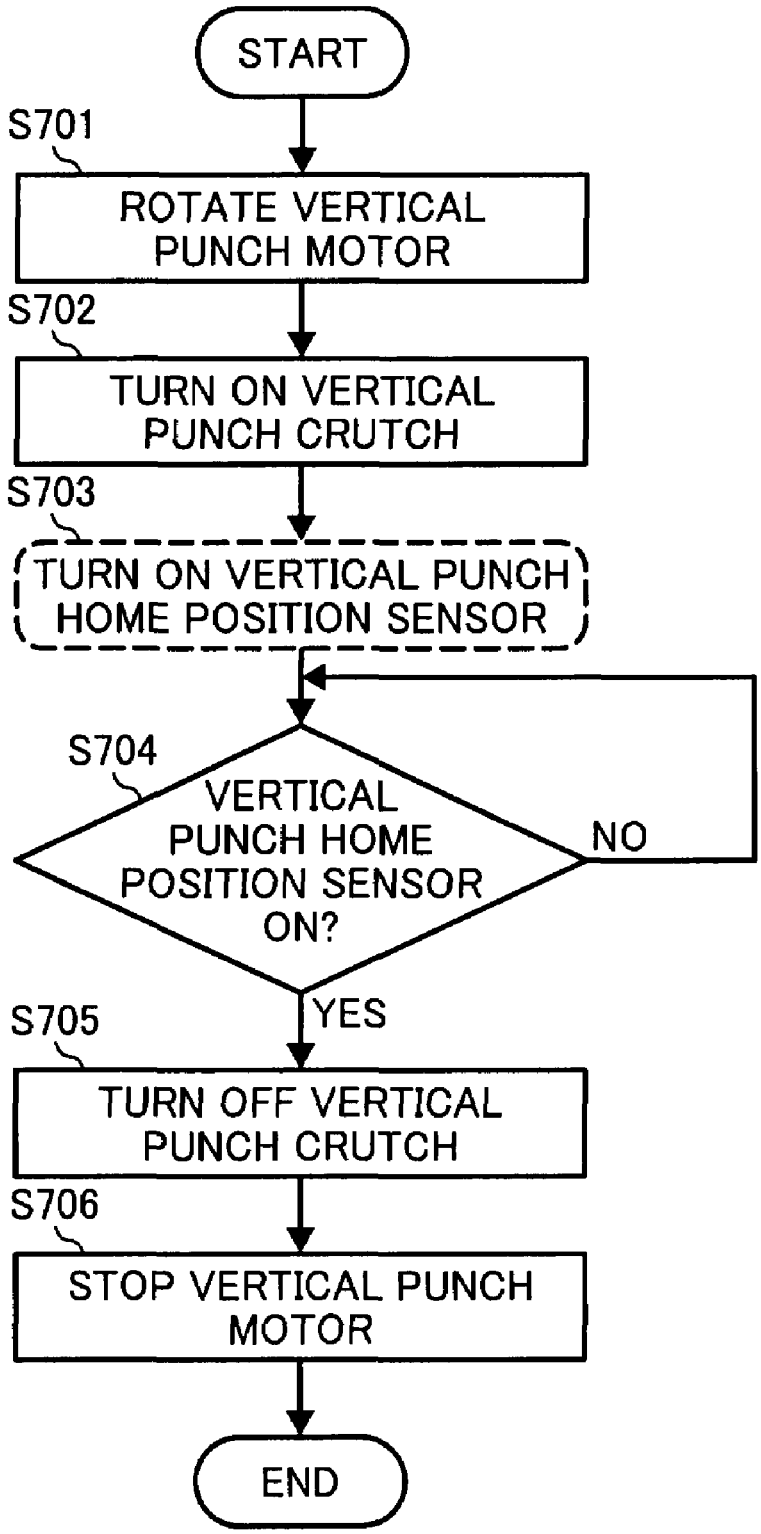
FIG. 37 is a flowchart (according to another example embodiment of the present invention) of a procedure for punching holes in a sheet included in the control procedures shown in FIG. 26B.

Referring to FIG. 37, the following describes procedures of step S505 shown in FIG. 34 and step S610 shown in FIG. 35B. Namely, FIG. 37 illustrates procedures for punching holes in a sheet P in the vertical or horizontal direction. The vertical punch unit 11 and the horizontal punch unit 10 (depicted in FIG. 22) have a common structure. Therefore, the following procedures are described by referring to the vertical punch unit 11.

In step S701, as illustrated in FIG. 22, the punch controller 101*a* (depicted in FIG. 25) rotates the vertical punch motor 67 in a given rotating direction. In step S702, the punch controller 101*a* turns on the vertical punch crutch 64. Simultaneously, the punch controller 101*a* checks whether or not the vertical punch home position sensor 65 is turned on (i.e., in a standby mode) in step S703. A driving force generated by the vertical punch motor 67 is transmitted to the vertical punch driving shaft 11*a* via the vertical punch crutch 64. A punch mechanism (not shown) punches holes in a sheet P and the vertical punch home position sensor 65 is turned off. However, the vertical punch home position sensor 65 is turned on again (i.e., in the standby mode) after the punch mechanism finishes punching holes. In step S704, the punch controller 101*a* determines whether or not the vertical punch home position sensor 65 is turned on. When the punch controller 101*a* determines that the vertical punch home position sensor 65 is turned on (i.e., if YES is selected in step S704), the punch controller 101*a* turns off the vertical punch crutch 64 in step S705. When a reference time period elapses, the punch controller 101*a* stops rotating the vertical punch motor 67 in step S706.

The above-described procedures are applicable to the procedures for punching holes in the horizontal direction performed by the horizontal punch unit 10.

The following describes effects provided by the above-described non-limiting example embodiments. The first folder (i.e., the corner folder 3 and/or the accordion folder 4 depicted in FIG. 1) folds a sheet P in a first direction. The aligning member (i.e., the upstream jogger fence 22*a* depicted in FIG. 6) contacts an edge of the folded sheet P opposite to another corner-folded edge so as to align the skewed sheet P. The aligned sheet P is sent to the second folder (i.e., the cross folder 6 depicted in FIG. 2). The second folder folds the sheet P in a second direction perpendicular to the first direction. Thus, a binding margin and a corner, which is corner-folded, of the sheet P are not buckled. After the aligning member aligns the skewed sheet P, the sheet P is straight conveyed to the second folder. Thus, the second folder can stably fold the sheet P in the second direction.

The aligning member is provided in an upstream portion of the switcher (i.e., the switcher 5 depicted in FIG. 2 or the switcher 5*a* depicted in FIG. 11) in the sheet conveyance direction. The switcher switches the sheet conveyance direction of the sheet P sent from the first folder. The aligning member provided in the upstream portion of the switcher can be manufactured at a decreased manufacturing cost than an aligning member provided in a downstream portion of the switcher.

The feeder (i.e., the feeder 23 depicted in FIG. 3) feeds back the sheet P toward the aligning member so that the edge of the sheet P contacts the aligning member. The feeder is provided near the aligning member. Thus, an area in which the sheet P is easily buckled may be reduced, preventing the sheet P from buckling.

When the sheet P sent from the first folder enters the switcher, the sheet P falls onto the aligning member provided in the upstream portion of the switcher in the sheet conveyance direction at a decreased speed. The edge of the sheet P opposite to another corner-folded edge contacts the aligning member. Thus, the binding margin and the corner, which is corner-folded, of the sheet P are not buckled. After the aligning member aligns the skewed sheet P, the sheet P is straight conveyed to the second folder. Thus, the second folder can stably fold the sheet P in the second direction.

When the sheet P sent from the first folder falls onto the aligning member, the aligning member moves to contact the tail edge of the sheet P in the sheet conveyance direction to align the sheet P. Thus, even if the sheet P is skewed when the sheet P falls onto the aligning member, the single aligning member, provided near the tail edge of the sheet P, can properly align the sheet P.

The switcher includes the guide (i.e., the guide 25 depicted in FIG. 6 and/or the guide 29 depicted in FIG. 12). The guide guides the sheet P sent from the first folder so that the sheet P falls onto the aligning member provided in the upstream portion of the switcher in the sheet conveyance direction. The edge of the sheet P opposite to another corner-folded edge contacts the aligning member. Thus, the binding margin and the corner, which is corner-folded, of the sheet P are not buckled. After the aligning member aligns the skewed sheet P, the sheet P is straight conveyed to the second folder. Thus, the second folder can stably fold the sheet P in the second direction.

The aligning member moves to contact the sheet P so as to align the skewed sheet P, and then the sheet P is sent to the second folder. In the second folder and devices provided downstream from the second folder in the sheet conveyance direction, the sheet P can be shifted to an arbitrary position in a direction perpendicular to the sheet conveyance direction. Thus, even when the output tray (i.e., the output tray 9 depicted in FIG. 1) does not move, the sheets P output onto the output tray are shifted from each other. Thus, collated sets of sheets P can be output onto the output tray.

When the aligning member moves to contact the sheet P so as to align the skewed sheet P, a center line of the sheet P in the direction perpendicular to the sheet conveyance direction (i.e., a feeding direction of the feeding roller 24 depicted in FIG. 24 serving as the conveying member) of the sheet P is positioned at a common, virtual line regardless of the folding type of the sheet P, before the sheet P is sent to the second folder. When the sheet P is sent to the turning device (i.e., the turning device 8 depicted in FIG. 1), the sheet P can pivot on the center of the sheet P. As a result the turning device can have a compact, space-saving size.

The procedures for aligning the skewed sheet P vary depending on the folding type of the sheet P, shortening a time period needed before outputting the sheet P onto the output tray. The second folder can properly fold the sheet P in the second direction perpendicular to the first direction.

The shortened procedures for aligning the skewed sheet P can be selected for a sheet P not to be folded in the second folder, shortening a time period needed for outputting the sheet P onto the output tray.

The shortened procedures for aligning the skewed sheet P are applied to a sheet P having the size of A4 portrait, A4 landscape, or A3 portrait, shortening a time period needed for outputting the sheet P onto the output tray.

The procedures providing an increased accuracy for aligning the skewed sheet P can be selected for a sheet P to be folded in the second folder. Thus, the second folder can properly fold the sheet P in the second direction perpendicular to the first direction.

The switcher includes the aligning member and the feeder (i.e., the feeder 23). The aligning member and the feeder align a sheet P skewed while conveyed from the first folder to the switcher. Thus, the aligned sheet P can be straight conveyed to the second folder. The second folder can stably fold the sheet P in the second direction perpendicular to the first direction.

The aligning member may be a jogger fence. After the jogger fence contacts and aligns a skewed sheet P, the center line of the sheet P in the sheet conveyance direction (i.e., the direction perpendicular to the feeding direction of the conveying member) is positioned at the common, virtual line regardless of the folding type of the sheet P.

The feeder has a roller shape and thereby can be manufactured at a cost lower than a belt.

The feeder includes the driven feed-back roller (i.e., the driven feed-back roller 23*a* depicted in FIG. 6) and the driving feed-back roller (i.e., the driving feed-back roller 23*b* depicted in FIG. 6). The driven feed-back roller and the guide (i.e., the guide 25 depicted in FIG. 6) are rotatably supported by a common shaft. When the driven feed-back roller contacts a sheet P, the guide can press the top surface of the sheet P regardless of the thickness of the sheet P folded in the first folder.

The driven feed-back roller instead of the driving feed-back roller pressingly contacts a sheet P, resulting in a simple structure and a decreased manufacturing cost of the feeder.

When the conveying member conveys a sheet P, the driving feed-back roller contacting the under surface of the sheet P applies a load to the conveying member via the sheet P. To address this problem, the conveying member disposed near the driving feed-back roller has a greater conveying force than the conveying member disposed away from the driving feed-back roller. Thus, the conveying forces of the conveying members disposed near and away from the driving feed-back roller are balanced with each other. As a result, the sheet P can be conveyed by the conveying member without being skewed.

When the aligning member provided in the upstream portion of the switcher in the sheet conveyance direction receives a sheet P fed by the entrance roller (i.e., the entrance roller 20 depicted in FIG. 6), the aligning member stops under the entrance roller (i.e., at the standby position). Thus, the sheet P fed by the entrance roller can properly fall onto the aligning member.

The present invention has been described above with reference to specific example embodiments. Nonetheless, the present invention is not limited to the details of the non-limiting example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A sheet processing apparatus comprising:

a first folder to fold a sheet in a first folding direction relative to a given orientation of the sheet, a line of the fold defining a second edge of the sheet;

a second folder to fold the folded sheet in a second folding direction perpendicular to the first folding direction; and a sheet aligner disposed between the first folder and the second folder, operable to switch a sheet conveyance direction of the sheet sent from the first folder and to align the sheet sent from the first folder, the sheet aligner including an aligning member arranged to face a first edge of the sheet, the first edge of the sheet being located relatively opposite to the second edge along the conveyance direction of the sheet, the second edge not having a straight line shape, a feeder to force the sheet in a given direction toward the aligning member so as to align the sheet in the sheet conveyance direction by contacting the first edge of the sheet against the aligning member, and a guide to move in accordance with a movement of a driven feed-back roller to guide the sheet toward the aligning member by contacting a top surface of the sheet, wherein the feeder includes a driving feed-back roller to face an under surface of the sheet, the driven feed-back roller to face the top surface of the sheet and a moving mechanism to move the driven feed-back roller upward and downward, the moving mechanism moves the driven feed-back roller upward to a standby position before the sheet aligner receives the sheet sent from the first folder and moves the driven feed-back roller downward to a pressing position at which the driven feed-back roller presses the sheet toward the driving feed-back roller so as to force the sheet toward the aligning member after the sheet aligner receives the sheet sent from the first folder.

2. The sheet processing apparatus according to claim 1, wherein the first edge of the sheet is a tail edge of the sheet in the sheet conveyance direction and the second edge of the sheet is a foremost edge of the sheet in the sheet conveyance direction, and wherein the second edge of the sheet is corner-folded.

3. The sheet processing apparatus according to claim 1, wherein the aligning member and the feeder are disposed at a position lower than a position at which the sheet sent from the first folder enters the sheet aligner.

4. The sheet processing apparatus according to claim 1, wherein the sheet aligner further includes a conveying member to feed the sheet aligned by the aligning member and the feeder in a transfer direction perpendicular to the given direction.

5. The sheet processing apparatus according to claim 4, wherein the aligning member is disposed at a reference position representing a position at which a center line of the sheet in the given direction coincides with a center line of the sheet in the direction perpendicular to the transfer direction.

6. The sheet processing apparatus according to claim 4, wherein the conveying member feeds the sheet toward the second folder after the sheet is aligned by the aligning member.

7. The sheet processing apparatus according to claim 1, wherein the aligning member is provided in an upstream portion of the sheet aligner in the sheet conveyance direction.

8. The sheet processing apparatus according to claim 7, wherein the feeder is provided near the aligning member.

9. The sheet processing apparatus according to claim 8, wherein the sheet sent from the first folder falls onto the aligning member provided in the upstream portion of the sheet aligner in the sheet conveyance direction at a decreased speed.

10. A sheet aligner for aligning a sheet, the sheet aligner comprising:

an aligning member arranged to face a first edge of the sheet, the first edge of the sheet being located relatively opposite to a second edge along a conveyance direction of the sheet, the second edge not having a straight line shape;

a feeder to force the sheet in a given direction toward the aligning member so as to align the sheet in the sheet conveyance direction by contacting the first edge of the sheet against the aligning member; and a guide to move in accordance with a movement of a driven feed-back roller to guide the sheet toward the aligning member by contacting a top surface of the sheet, wherein the feeder includes a driving feed-back roller to face an under surface of the sheet, the driven feed-back roller to face the top surface of the sheet, and a moving mechanism to move the driven feed-back roller upward and downward, and the moving mechanism moves the driven feed-back roller upward to a standby position before the sheet aligner receives the sheet and moves the driven feed-back roller downward to a pressing position at which the driven feed-back roller presses the sheet toward the driving feed-back roller so as to force the sheet toward the aligning member after the sheet aligner receives the sheet.

11. The sheet aligner according to claim 10, further comprising:

a conveying member to feed the sheet aligned by the aligning member and the feeder in a transfer direction perpendicular to the given direction.

12. A sheet aligner for aligning a sheet, the sheet aligner comprising:

an aligning member arranged to face a first edge of the sheet, the first edge of the sheet being located relatively opposite to a second edge along a conveyance direction of the sheet, the second edge not having a straight line shape; and a feeder to force the sheet in a given direction toward the aligning member so as to align the sheet in the sheet conveyance direction by contacting the first edge of the sheet against the aligning member, wherein the feeder includes a driving feed-back roller to face an under surface of the sheet, a driven feed-back roller to face a top surface of the sheet, and a moving mechanism to move the driven feed-back roller upward and downward.

13. The sheet aligner according to claim 12, wherein the moving mechanism moves the driven feed-back roller upward to a standby position before the sheet aligner receives the sheet and moves the driven feed-back roller downward to a pressing position at which the driven feed-back roller presses the sheet toward the driving feed-back roller so as to force the sheet toward the aligning member after the sheet aligner receives the sheet.

14. A sheet processing apparatus comprising:

the sheet aligner of claim 12.

* * * * *